US011835274B2

(12) United States Patent
Kim et al.

(10) Patent No.: US 11,835,274 B2
(45) Date of Patent: Dec. 5, 2023

(54) AIR CONDITIONER

(71) Applicant: SAMSUNG ELECTRONICS CO., LTD., Suwon-si (KR)

(72) Inventors: Munsub Kim, Suwon-si (KR); Jaewoo Choi, Suwon-si (KR); Hyeongjoon Seo, Suwon-si (KR); Duhan Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 84 days.

(21) Appl. No.: 17/036,283

(22) Filed: Sep. 29, 2020

(65) Prior Publication Data

US 2021/0102736 A1 Apr. 8, 2021

(30) Foreign Application Priority Data

Oct. 4, 2019 (KR) ..... 10-2019-0122785
Jun. 26, 2020 (KR) ..... 10-2020-0078706

(51) Int. Cl.
*F25B 41/40* (2021.01)
*F25B 43/00* (2006.01)
(Continued)

(52) U.S. Cl.
CPC ..... *F25B 41/40* (2021.01); *F25B 41/20* (2021.01); *F25B 41/31* (2021.01); *F25B 43/003* (2013.01); *F25B 2500/12* (2013.01)

(58) Field of Classification Search
CPC ..... F25B 41/40; F25B 41/20; F25B 41/31; F25B 43/003; F25B 2500/12
See application file for complete search history.

(56) References Cited

U.S. PATENT DOCUMENTS 5,659,158 A 8/1997 Browning et al.
6,148,631 A * 11/2000 Watanabe ..... F25B 41/40 62/296
(Continued)

FOREIGN PATENT DOCUMENTS

CN 1467449 A 1/2004
CN 201731603 U 2/2011
(Continued)

OTHER PUBLICATIONS

International Search Report dated Jan. 21, 2021 from International Application No. PCT/KR2020/013338, 3 pages.
(Continued)

*Primary Examiner* — Henry T Crenshaw
(74) *Attorney, Agent, or Firm* — STAAS & HALSEY LLP

(57) ABSTRACT

An air conditioner includes a compressor, an outdoor heat exchanger, an expansion device, an indoor heat exchanger, and a noise reduction device configured to reduce flow noise of a refrigerant. The noise reduction device includes a housing including a refrigerant inlet and a refrigerant outlet, and a plurality of baffles disposed inside the housing. The baffles include a first baffle and a second baffle that partition an inside of the housing into a plurality of spaces in a flow direction of the refrigerant. Each of the first baffle and the second baffle includes a hole through which the refrigerant passes. The holes of the first and second baffles are respectively disposed at centers of the first and second baffles at positions corresponding to each other in the flow direction of the refrigerant.

20 Claims, 25 Drawing Sheets

(51) Int. Cl.
*F25B 41/20* (2021.01)
*F25B 41/31* (2021.01)

(56) References Cited

U.S. PATENT DOCUMENTS

| | | | | |
|---|---|---|---|---|
| 6,837,260 | B1 * | 1/2005 | Kuehn | A61M 16/0069 137/487 |
| 2009/0308686 | A1 * | 12/2009 | Sullivan | F01N 1/003 181/255 |
| 2019/0277547 | A1 | 9/2019 | Lambert et al. | |

FOREIGN PATENT DOCUMENTS

| | | | | |
|---|---|---|---|---|
| CN | 103913020 | A | 7/2014 | |
| CN | 204006602 | U | 12/2014 | |
| CN | 207422621 | | 5/2018 | |
| EP | 1 371 920 | | 12/2003 | |
| EP | 1 371 920 | A2 | 12/2003 | |
| EP | 1371920 | A2 * | 12/2003 | F24F 1/00 |
| EP | 1371920 | A2 | 12/2003 | |
| JP | 2002107005 | A * | 4/2002 | |
| JP | 2006-266636 | | 10/2006 | |
| KR | 2000-0000873 | | 1/2000 | |
| KR | 2002-0078231 | | 10/2002 | |
| KR | 10-0474909 | | 3/2005 | |
| KR | 10-2005-0102481 | | 10/2005 | |
| KR | 10-0624788 | | 9/2006 | |
| KR | 10-0645811 | | 11/2006 | |
| KR | 10-0645812 | | 11/2006 | |
| KR | 10-0657526 | | 12/2006 | |
| KR | 10-2009-0041729 | | 4/2009 | |
| KR | 10-1253634 | | 4/2013 | |
| KR | 10-2016-0143124 | A | 12/2016 | |
| WO | 85/00853 | A1 | 2/1985 | |

OTHER PUBLICATIONS

Extended European Search Report dated Aug. 1, 2022 for European Application No. 20872362.7.
Chinese Office Action dated Mar. 15, 2023 for Chinese Application No. 202080069985.7.

* cited by examiner

AIR CONDITIONER

CROSS-REFERENCE TO RELATED APPLICATION

This application is based on and claims priority under 35 U.S.C. § 119 to Korean Patent Applications No. 10-2019-0122785, filed on Oct. 4, 2019 and No. 10-2020-0078706, filed on Jun. 26, 2020 in the Korean Intellectual Property Office, the disclosures of which are incorporated by reference in their entirety.

BACKGROUND

1. Field

The disclosure relates to an air conditioner, and more specifically, to an air conditioner including a noise reduction device for reducing noise of a refrigerant.

2. Description of the Related Art

In general, an air conditioner is an apparatus which adjusts temperature, humidity, an air current, etc. to provide a comfortable user environment using a refrigerating cycle and removes dust from air. As main components constituting the refrigerating cycle, a compressor, a condenser, an expansion device, and an evaporator are provided.

The air conditioner may include an outdoor unit and an indoor unit, and the outdoor unit may include a compressor, an outdoor heat exchanger, an expansion device, and the like. The indoor unit may include an indoor heat exchanger, a blower fan, and the like, and the expansion device may be provided in the indoor unit or the outdoor unit.

On the other hand, when a two-phase refrigerant discharged from the outdoor unit of the air conditioner flows through a buried pipe of an apartment, the flow of the refrigerant may become unstable due to foreign substances in the pipe or bending of the pipe. That is, the refrigerant may form a slug flow, and when the refrigerant in a slug flow state flows into the indoor heat exchanger or the expansion device, irregular refrigerant noise may occur.

SUMMARY

Therefore, it is an object of the disclosure to provide a noise reduction device capable of improving the flow noise of an irregular refrigerant, and an air conditioner having the same.

It is another object of the disclosure to provide a noise reduction device capable of stabilizing the flow of an unstable refrigerant, and an air conditioner having the same.

Additional aspects of the disclosure will be set forth in part in the description which follows and, in part, will be obvious from the description, or may be learned by practice of the disclosure.

According to an aspect of the disclosure, there is provided an air conditioner including: a compressor configured to compress a refrigerant; an outdoor heat exchanger allowing the refrigerant to have heat exchanged with outdoor air; an expansion device configured to expand the refrigerant; an indoor heat exchanger allowing the refrigerant to have heat exchanged with indoor air; and a noise reduction device configured to reduce flow noise of the refrigerant, wherein the noise reduction device includes a housing including a refrigerant inlet and a refrigerant outlet, and a plurality of baffles disposed inside the housing and including a first baffle and a second baffle that partition an inside of the housing into a plurality of spaces in a flow direction of the refrigerant; and each of the first baffle and the second baffle includes a hole through which the refrigerant passes, the holes of the first and second baffles are respectively disposed at centers of the first and second baffles, and are disposed at positions corresponding to each other in the flow direction of the refrigerant.

The holes of the first and second baffles may be disposed collinear with each other in the flow direction of the refrigerant.

Each of the first and second baffles may include a first surface opposite to the flow direction, wherein each of the first surfaces may include a first inclined portion formed to be inclined from the corresponding hole in the first and second baffles toward outside thereof in the flow direction of the refrigerant.

Each of the first and second baffles may include a second surface disposed on a side opposite to the first surface, and each of the second surfaces may include a second inclined portion provided to be symmetrical to the first inclined portion with respect to a direction perpendicular to the flow direction of the refrigerant.

The air conditioner may further include an outdoor unit in which the compressor and the outdoor heat exchanger are installed, and an indoor unit in which the expansion device and the indoor heat exchanger are installed, wherein the noise reduction device may be disposed in the indoor unit.

The noise reduction device may include a frame configured to fix the plurality of baffles, wherein the frame may include a first frame and a second frame formed to allow the plurality of baffles to be fixed to the frame inside the housing, extending in the flow direction of the refrigerant, and individually separable in a direction perpendicular to the flow direction of the refrigerant, each of the plurality of baffles may include a first portion and a second portion separable in the direction perpendicular to the flow direction of the refrigerant, the first portions of the plurality of baffles may be connected to the first frame, and the second portions of the plurality of baffles may be connected to the second frame.

The first portions of the plurality of baffles and the first frame may form a first assembly of the noise reduction device, the second portions of the plurality of baffles and the second frame may form a second assembly of the noise reduction device, and the plurality of baffles may be formed when the first assembly and the second assembly are coupled to each other.

Each of the first assembly and the second assembly may be provided as a unitary body, and have a same shape.

The first assembly may have a first hook portion hooked with the second frame in the direction perpendicular to the flow direction of the refrigerant when the first assembly and the second assembly are coupled to each other in the direction perpendicular to the flow direction of the refrigerant, and the second assembly may have a second hook portion hooked with the first frame in the direction perpendicular to the flow direction of the refrigerant when the first assembly and the second assembly are coupled to each other in the direction perpendicular to the flow direction of the refrigerant.

The first frame may be provided in a pair, and the first hook portion may include a plurality of hooks, wherein the plurality of hooks may be alternately disposed on one of the pair of first frames and an other one of the pair of first frames in the flow direction of the refrigerant.

Each of the first baffle and the second baffle may include a plurality of ribs protruding from an outer circumferential surface thereof toward an inner circumferential surface of the housing while being spaced apart from each other in a circumferential direction of the outer circumferential surface thereof.

The plurality of baffles may further include a third baffle disposed to be spaced apart from the first and second baffles in the flow direction of the refrigerant and formed with a hole through which the refrigerant passes, and the hole of the third baffle may be disposed at a position corresponding to the holes of the first and second baffles in the flow direction of the refrigerant, wherein each of the plurality of baffles may further include a frame extending in the flow direction of the refrigerant so as to be coupled to one of the plurality of baffles adjacent thereto, the frame of the first baffle may be coupled to the second baffle, and the frame of the second baffle is coupled to the third baffle, and the first and third baffles may be disposed in-phase with each other in a circumferential direction of outer circumferential surfaces of the plurality of baffles, and the second baffle is disposed out of phase with the first and third baffles.

The noise reduction device may further include a filter provided to collect foreign substances in the refrigerant introduced through the refrigerant inlet.

The filter may be disposed in line with the plurality of baffles in the flow direction of the refrigerant inside the housing.

The air condition may further include a refrigerant pipe connected to the refrigerant inlet and the refrigerant outlet to connect the expansion device to the indoor heat exchanger, wherein the holes of the first and second baffles may have a diameter of 0.4 times larger than or equal to a diameter of the refrigerant pipe and 3 times smaller than or equal to the diameter of the refrigerant pipe.

According to another aspect of the disclosure, there is provided an air conditioner including: a compressor configured to compress a refrigerant; an outdoor heat exchanger allowing the refrigerant to have heat exchanged with outdoor air; an expansion device configured to expand the refrigerant; an indoor heat exchanger allowing the refrigerant to have heat exchanged with indoor air; and a noise reduction device disposed between the expansion device and the indoor heat exchanger to reduce flow noise of the refrigerant flowing from the expansion device to the indoor heat exchanger, wherein the noise reduction device includes a plurality of baffles having holes through which the refrigerant flow, and the holes of the plurality of baffles are respectively disposed at centers of the plurality of baffles, and are disposed at positions corresponding to each other in a flow direction of the refrigerant.

The air conditioner may further include a refrigerant pipe connecting the expansion device to the indoor heat exchanger, and the noise reduction device may be inserted into the refrigerant pipe.

The noise reduction device may further include a housing including a refrigerant inlet and a refrigerant outlet, and the plurality of baffles may be disposed inside the housing.

The plurality of baffles may have a same shape while being disposed at equal intervals in the flow direction of the refrigerant.

According to another aspect of the disclosure, there is provided an air conditioner including: a compressor configured to compress a refrigerant; an outdoor heat exchanger allowing the refrigerant to have heat exchanged with outdoor air; an expansion device configured to expand the refrigerant; an indoor heat exchanger allowing the refrigerant to have heat exchanged with indoor air; and a noise reduction device disposed between the outdoor heat exchanger and the expansion device to reduce flow noise of the refrigerant flowing from the outdoor heat exchanger to the expansion device, wherein the noise reduction device includes: a housing including a refrigerant inlet and a refrigerant outlet; a plurality of baffles including holes through which the refrigerant flows; and a filter provided to collect foreign substances in the refrigerant introduced through the refrigerant inlet, and the plurality of baffles are disposed in line with the filter in the flow direction of the refrigerant.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
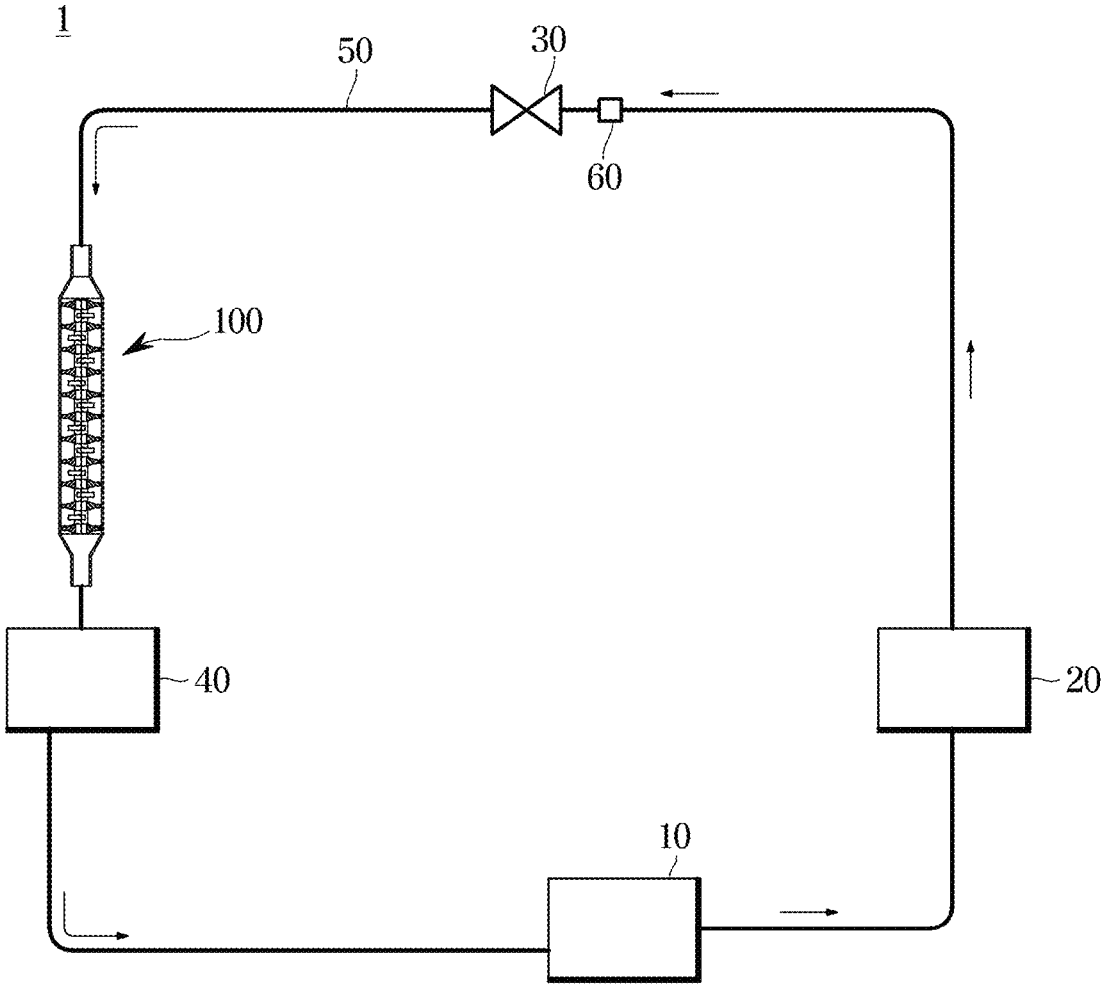
FIG. 1 is a view illustrating a refrigerant flow of an air conditioner according to an embodiment of the disclosure.

The embodiments set forth herein and illustrated in the configuration of the disclosure are only the most preferred embodiments and are not representative of the full technical spirit of the disclosure, so it should be understood that they may be replaced with various equivalents and modifications.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "upper", "lower", "left" and "right" as herein used are defined with respect to the drawings, but the terms may not restrict the shape and position of the respective components.

Hereinafter, embodiments according to the disclosure will be described in detail with reference to the accompanying drawings.

FIG. 1 is a view illustrating a refrigerant flow of an air conditioner according to an embodiment of the disclosure.

Referring to FIG. 1, an air conditioner 1 includes a compressor 10 to compress a refrigerant, an outdoor heat exchanger 20 allowing the compressed high temperature and high pressure refrigerant to have heat exchanged with outside air, an expansion device 30 to decompress the refrigerant discharged from the outdoor heat exchanger 20 into a low temperature refrigerant, a noise reduction device 100 connected to the expansion device 30 to stabilize the flow of unstable refrigerant to reduce the flow noise of the refrigerant, and an indoor heat exchanger 40 connected to the noise reduction device 100 and allowing the low temperature refrigerant to have heat exchanged with indoor air to lower the temperature of the indoor air. The outdoor heat exchanger 20 may refer to a condenser, and the indoor heat exchanger 40 may refer to an evaporator.

The indoor heat exchanger 40 may be provided in plural. That is, the refrigerant compressed and condensed in the single compressor 10 and the outdoor heat exchanger 20 may be provided to flow to the plurality of indoor heat exchangers 40 and then be circulated to the single compressor 10 again. In this case, the expansion device 30 and the noise reduction device 100 may be provided corresponding in number to the number of the indoor heat exchangers 40.

The following description is made in relation that each configuration is provided as a single unit. However, even when a plurality of the indoor heat exchangers 40 are provided, the disclosure may be applied in the same manner.

The expansion device 30 may be connected to the indoor heat exchanger 40 by a refrigerant pipe 50 to allow a refrigerant to flow. The noise reduction device 100 may be disposed on the refrigerant pipe 50 such that the refrigerant flowing in the refrigerant pipe 50 passes through the noise reduction device 100 and flows into the indoor heat exchanger 40.

The air conditioner 1 may include a filter 60 provided between the expansion device 30 and the outdoor heat exchanger 20 to prevent foreign substances in the refrigerant flowing into the expansion device 30 from flowing into an expansion valve (not shown) of the expansion device 30.

In the air conditioner 1 having the above configuration, the flow of a refrigerant is as follows. A low-temperature and low-pressure gaseous refrigerant is compressed to a high-temperature and high-pressure refrigerant through the compressor 10 and changes phase into a liquid in the outdoor heat exchanger 20. The liquid refrigerant passed through the outdoor heat exchanger 20 is converted into a two-phase refrigerant while passing through the expansion device 30.

In this case, the flow of the two-phase refrigerant may form an unstable slug flow, and when the refrigerant in a slug flow state is introduced into the indoor heat exchanger 40, irregular refrigerant noise may occur. The refrigerant noise will be described in detail below.

The air conditioner 1 according to the aspect of the disclosure includes the noise reduction device 100 between the expansion device 30 and the indoor heat exchanger 40 to stabilize the flow of the refrigerant, thereby reducing irregular refrigerant noise described above.

The refrigerant may pass through the expansion device 30 and flow into the noise reduction device 100. As described above, the unstable refrigerant flow is stabilized while passing through the noise reduction device 100 and introduced into the indoor heat exchanger 40. The refrigerant evaporates in the indoor heat exchanger 40 to become a low-temperature and low-pressure gaseous refrigerant.

The compressor 10, the outdoor heat exchanger 20, the expansion device 30, and the filter 60 may be installed in the outdoor unit of the air conditioner 1. The indoor heat exchanger 40 may be installed in the indoor unit of the air conditioner 1.

However, the disclosure is not limited thereto, and the expansion device 30 may be installed in the indoor unit of the air conditioner 1. In addition, the filter 60 may be installed in the outdoor unit or the indoor unit together with the expansion device 30.

Hereinafter, the noise reduction device 100 of the air conditioner 1 according to the embodiment of the disclosure will be described in detail.

Figure 2:
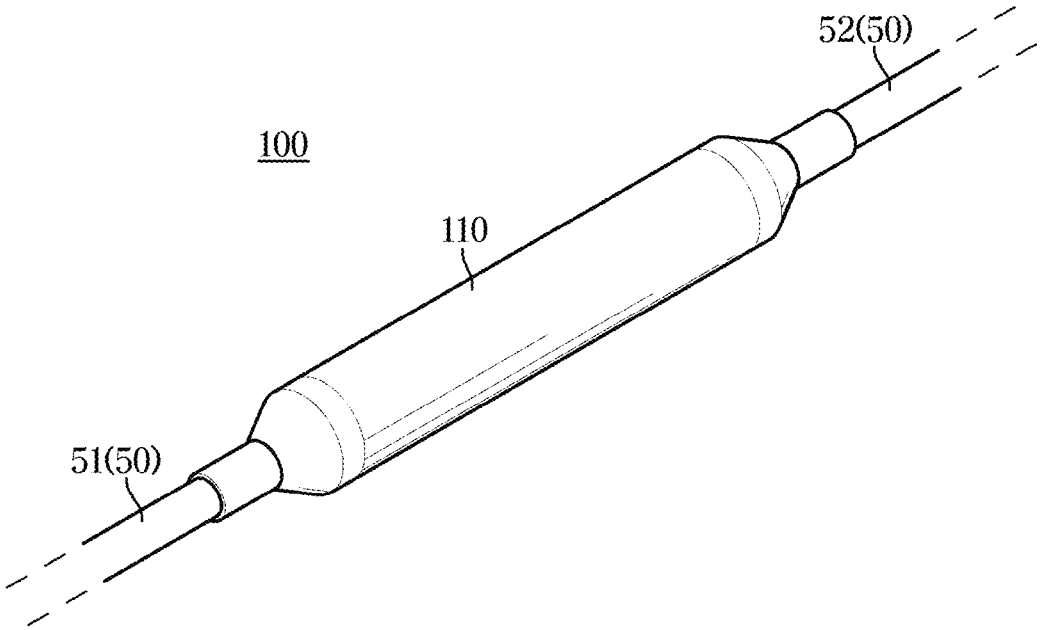
FIG. 2 is a perspective view illustrating a noise reduction device according to an embodiment of the disclosure.
Figure 3:
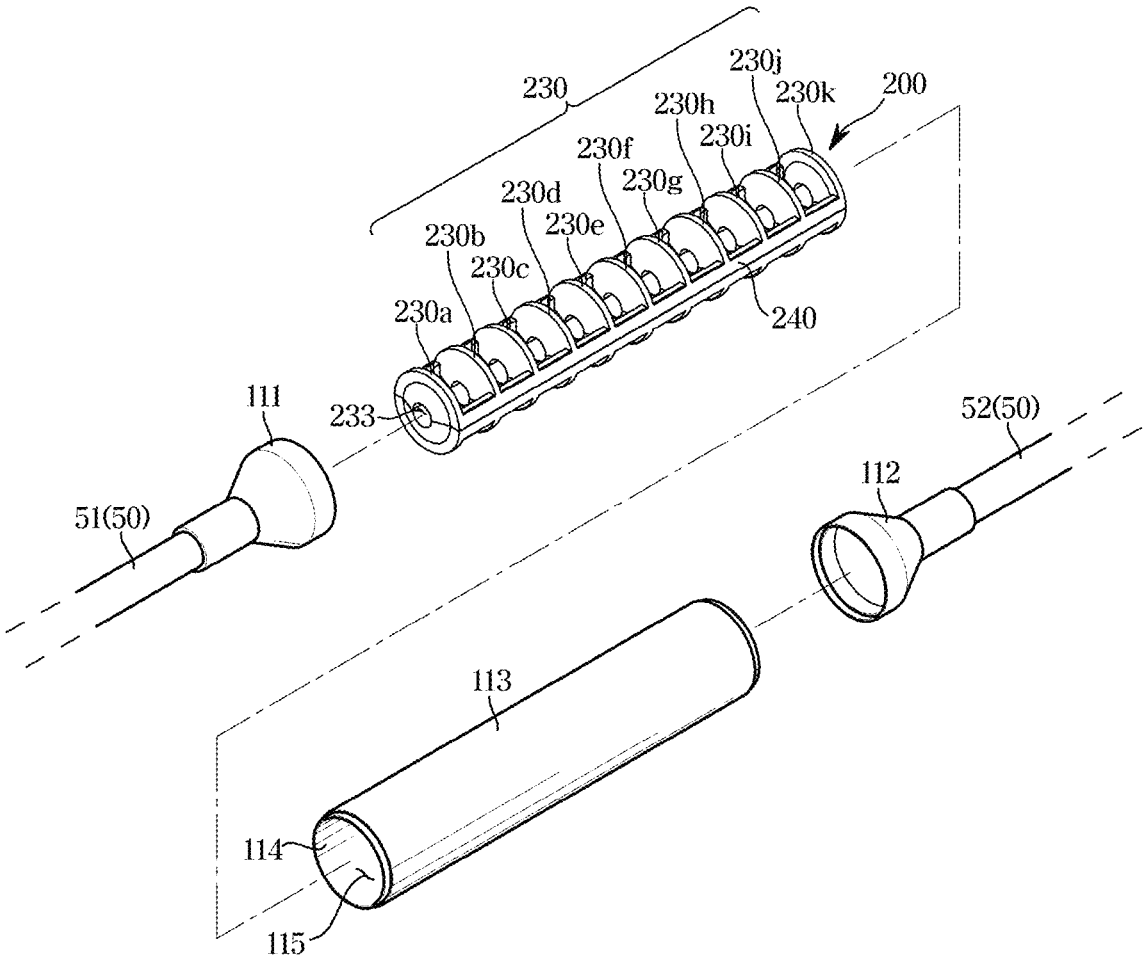
FIG. 3 is an exploded perspective view illustrating the noise reduction device shown in FIG. 2.
Figure 4:
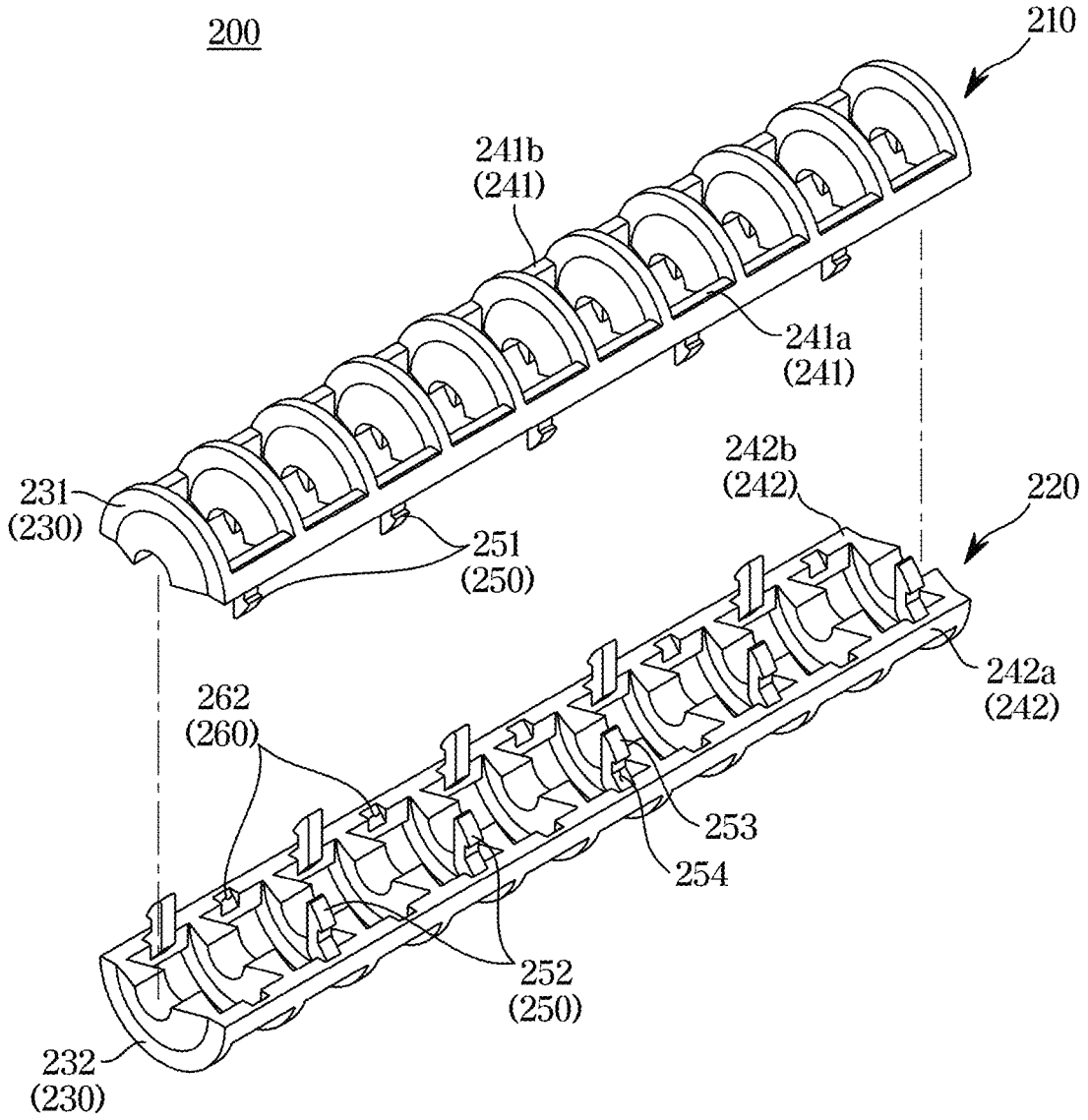
FIG. 4 is an exploded perspective view illustrating a structure body of the noise reduction device shown in FIG. 3.
Figure 5:
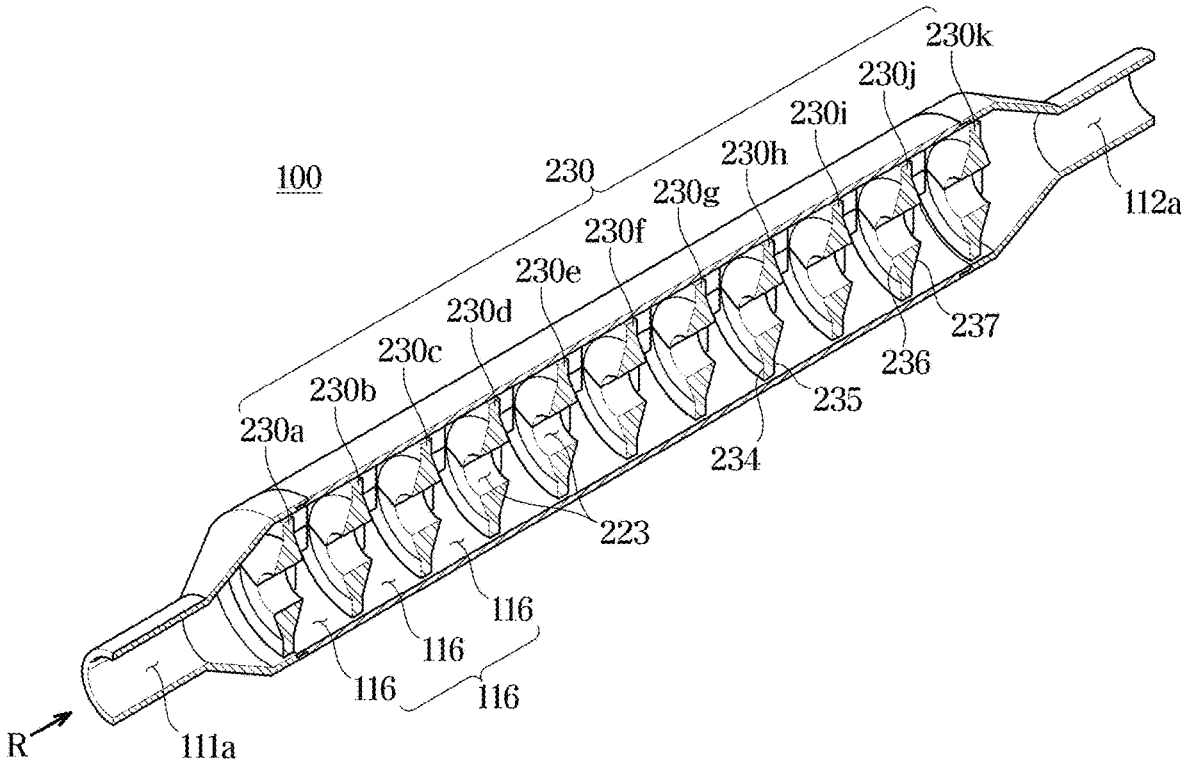
FIG. 5 is a cross-sectional perspective view illustrating the noise reduction device shown in FIG. 2.

FIG. 2 is a perspective view illustrating a noise reduction device according to an embodiment of the disclosure, FIG. 3 is an exploded perspective view illustrating the noise reduction device shown in FIG. 2, FIG. 4 is an exploded perspective view illustrating a structure body of the noise reduction device shown in FIG. 3, and FIG. 5 is a cross-sectional perspective view illustrating the noise reduction device shown in FIG. 2.

In the conventional noise reduction device, in order to improve the flow noise of the two-phase refrigerant, a branch pipe having a partition wall and a complicated flow path is installed inside the noise reduction device to mix the refrigerant in the internal space divided by the partition wall so that the flow of the refrigerant is stabilized.

In this case, the partition wall and the branch pipe installed inside the noise reduction device are formed of metal to withstand the pressure of the refrigerant, and are coupled to the inside of the noise reduction device by welding or the like so as to be fixed.

With the welding process, the noise reduction device has a difficulty in implementing a sophisticated structure, and the welding process itself is complicated compared to a general assembly process, which results in a low manufacturability.

In addition, in order to increase the noise improvement effect of the noise reduction device, a space in which the refrigerant is mixed needs to be secured wide, which causes the noise reduction device to have a large configuration, and the installation of the noise reduction device to be lowered. In other words, when the noise reduction device having a large size is placed in the indoor unit, the indoor unit also needs to have a large size, and even when the noise reduction device is installed outside the indoor unit, the installation of the noise reduction device is limited due to the large size.

Accordingly, the noise reduction device 100 of the air conditioner 1 according to the embodiment of the disclosure may minimize welding of the internal configurations of the noise reduction device 100 to improve the assembling property of the noise reduction device 100 and minimize the size of the noise reduction device 100 to improve the installation of the noise reduction device 100.

In detail, a structure body 200 including a plurality of baffles 230 including holes through which a refrigerant passes may be inserted into the noise reduction device 100 so that the assembling property of the noise reduction device 100 is improved.

In addition, the refrigerant is not simply mixed the refrigerant in the noise reduction device 100, but is rectified through two phase separation of the refrigerant so that the refrigerant may be stabilized in a small space and the installation of the noise reduction device 100 may be improved.

Referring to FIGS. 2 and 3, the noise reduction device 100 may include a housing 110 including a refrigerant flow-in portion 111 including a refrigerant inlet 111*a* (FIG. 5), a refrigerant flow-out portion 112 including a refrigerant outlet 112*a* (FIG. 5), and a body 113 forming the external appearance thereof.

The refrigerant flow-in portion 111 may be provided in a cone shape including a hollow and having an inner diameter increasing in the flow direction of the refrigerant from the refrigerant inlet 111*a*. The refrigerant flow-out portion 112 may be provided in a cone shape including a hollow and having an inner diameter decreasing in the flow direction of the refrigerant.

The refrigerant pipe 50 may include a first pipe 51 connected to the refrigerant flow-in portion 111 and a second pipe 52 connected to the refrigerant flow-out portion 112.

The body 113 may be provided in a cylindrical shape including a hollow. The body 113 may include an inner circumferential surface 114 forming the hollow and an internal space 115 inside the hollow formed by the inner circumferential surface 114. The maximum diameters of the refrigerant flow-in portion 111 and the refrigerant flow-out portion 112 may be provided to substantially correspond to the diameter of the body 113. The noise reduction device 100 may include a structure body 200 including a plurality of baffles 230. The structure body 200 may be provided to be inserted into the housing 110.

After the structure body 200 is inserted into the housing 110, the refrigerant flow-in portion 111, the refrigerant flow-out portion 112, and the body 113 of the housing 110 may be coupled through welding or the like, into a unitary assembly. However, the disclosure is not limited thereto, and the refrigerant flow-in portion 111, the refrigerant flow-out portion 112, and the body 113 of the housing 110 may be coupled by a separate coupling configuration may be separably coupled.

In addition, the disclosure is not limited to the embodiment, and one of the refrigerant flow-in portion 111 and the refrigerant flow-out portion 112 may be integrally formed with the body 113. After the structure body 200 is inserted into the body 113, the other one of the refrigerant flow-in portion 111 and the refrigerant flow-out portion 112 may be coupled to the body 113.

In addition, the refrigerant flow-in portion 111, the refrigerant flow-out portion 112, and the body 113 may be formed as an integral housing 110, and the housing 110 may be provided as two configurations that are separably coupled to each other without distinguishing the refrigerant flow-in portion 111, the refrigerant flow-out portion 112, and the 113.

The structure body 200 may be inserted into the internal space 115 formed on the inner circumferential surface 114 of the housing 110. The structure body 200 may include the plurality of baffles 230 and a frame 240 supporting the plurality of baffles 230. Each of the plurality of baffles 230 may have the same shape. However, the disclosure is not limited thereto, and the plurality of baffles 230 may have different shapes, and at least some of the plurality of baffles 230 may have different shapes. The plurality of baffles 230 may be provided in a disk shape having a predetermined thickness. The plurality of baffles 230 may each include a hole 233 through which a refrigerant passes. The holes 233 of the plurality of baffles 230 may be disposed in the centers of the plurality of baffles 230.

The plurality of baffles 230 include a first baffle 230*a* disposed adjacent to the refrigerant flow-in portion 111 and a second baffle 230*b* disposed adjacent to the first baffle 230*a* in the direction in which the refrigerant flows.

In addition, the plurality of baffles 230 may include additional baffles, such as a third baffle 230*c* and a fourth baffle 230*d* in the direction in which the refrigerant flows. According to the embodiment of the disclosure, the plurality of baffles 230 may include eleven baffles from a first baffle 230*a* to an eleventh baffle 230*k*, but the disclosure is not limited thereto, and may include more or less than eleven baffles. However, the plurality of baffles 230 may at least include the first baffle 230*a* and the second baffle 230*b*.

The plurality of baffles 230 may be spaced apart from each other in the direction in which the refrigerant flows. The plurality of baffles 230 may partition the internal space 115 in the direction in which the refrigerant flows. That is, the internal space 115 may be divided into a plurality of unit internal spaces 116 by the structure body 200.

The frame 240 may support each of the plurality of baffles 230 spaced apart from each other in the direction in which the refrigerant flows to keep the plurality of baffles 230 in position. The frame 240 may be provided in a pair. However, the disclosure is not limited thereto, and the frame 240 may be formed as a single unit or three or more units thereof.

The frame 240 may be disposed on a side of the outer circumferential surfaces of the plurality of baffles 230. The pair of frames 240 may be disposed with a phase difference of about 180 degrees in a circumferential direction of the plurality of baffles 230. However, the disclosure is not limited thereto, and the pair of frames 240 may be disposed with various phase differences in the circumferential direction of the plurality of baffles 230.

For the sake in convenience of description, a pair of the frames 240 are represented by a frame 240 unless needed to be distinguished.

In this way, the plurality of baffles 230 and the frame 240 may form a single structure body 200. The single structure body 200 is simply inserted into the housing 110 and the housing 110 is sealed through welding or the like, so that the noise reduction device 100 may be manufactured.

The structure body 200 may be formed to have a length substantially corresponding to an extension length of the body 113 in the direction in which the refrigerant flows. In addition, the structure body 200 may include an outer circumferential surface having a diameter substantially corresponding to the diameter of the inner circumferential surface 114 of the body 113.

The refrigerant flow-in portion 111 and the refrigerant flow-out portion 112, which are provided in a cone shape, may have a diameter smaller than that of the inner circumferential surface 114 of the body 113. Accordingly, when the structure body 200 is inserted into the body 113, the structure body 200 may be fixed inside the body 113 without additional fixing.

Such a manufacturing process does not require a process of welding the plurality of baffles 230 to the inside of the housing 110, and the noise reduction device 100 is manufactured by only a process of inserting the single structure body 200 into the internal space 115 of the housing 110, so that the assembling property of the noise reduction device 100 may be improved.

Referring to FIGS. 4 and 5, the structure body 200 may be formed by assembling a first assembly 210 and a second assembly 220. However, the disclosure is not limited thereto, and the structure body 200 may be formed as a single configuration by injection or the like.

The first assembly 210 and the second assembly 220 may be separably provided. Accordingly, the structure body 200 may be formed by the first and second assemblies 210 and 220 being coupled to each other.

The first assembly 210 and the second assembly 220 may be coupled to each other and separated from each other in a direction perpendicular to the flow direction of the refrigerant. The plurality of baffles 230 may include a first portion 231 and a second portion 232. The first portion 231 and the second portion 232 are portions of the plurality of baffles 230 that are divided by the first assembly 210 and the second assembly 220. That is, the first portion 231 and the second portion 232 may be separate parts defined when the plurality of baffles 230 are split into two sections in the direction perpendicular to the flow direction of the refrigerant.

The frame 240 may include a first frame 241 and a second frame 242. The first frame 241 and the second frame 242 may be provided to be separable. A single frame 240 may be formed by the first frame 241 and the second frame 242 being coupled to each other. The first frame 242 and the second frame 242 are portions of the frame 240 that are divided by the first assembly 210 and the second assembly 220. That is, the first frame 241 and the second frame 242 may be separate parts defined when the frame 240 is split into two sections in the direction perpendicular to the flow direction of the refrigerant.

The first assembly 210 may include the first frame 241 and the first portion 231 of the plurality of baffles 230. The first frame 241 and the first portion 231 may be integrally provided.

The second assembly 220 may include the second frame 242 and the second portion 232 of the plurality of baffles 230. The second frame 242 and the second portion 232 may be integrally provided.

Accordingly, when the first assembly 210 and the second assembly 220 are coupled to each other, the plurality of baffles 230 and the frame 240 may be integrally provided. The first and second assemblies 210 and 220 may each include a hook portion 250 to restrain one of the first assembly 210 and the second assembly 220 corresponding thereto when the first and second assemblies 210 and 220 are coupled to each other. The hook portion 250 may be provided to hold the first assembly 210 and the second assembly 220 coupled.

The first assembly 210 includes a first hook portion 251 that is hook-coupled to the second frame 242 in the direction perpendicular to the flow direction of the refrigerant when the first and second assemblies 210 and 220 are coupled to each other in the direction perpendicular to the flow direction of the refrigerant.

The second assembly 220 includes a second hook portion 252 that is hook-coupled to the first frame 241 in the direction perpendicular to the flow direction of the refrigerant when the first and second assemblies 210 and 220 are coupled to each other in the direction perpendicular to the flow direction of the refrigerant.

The first and second hook portions 251 and 252 may respectively protrude from the first and second frames 241 and 242 in the direction perpendicular to the flow direction of the refrigerant. The first and second hook portions 251 and 252 may each include a plurality of hooks 253 and a support groove 254 supporting the frame.

The first and second assemblies 210 and 220 may each include a guide 260 for guiding the hook portion 250 thereof to be hook-coupled to one of the first frame 241 and the second frame 242 corresponding thereto when the first and second assemblies 210 and 220 are coupled to each other in the direction perpendicular to the flow direction of the refrigerant.

The first frame 241 may include a first guide (not shown) for guiding hook coupling with the second hook portion 252. The second frame 242 may include a second guide 262 for guiding hook coupling with the first hook portion 251. The second guide 262 may be disposed on the second frame 242 at a position corresponding to the first hook portion 251 in a direction perpendicular to the flow direction of the refrigerant. The second guide 262 may be formed as a groove inclined with respect to the direction perpendicular to the flow direction of the refrigerant.

When the first and second assemblies 210 and 220 approach each other in the direction perpendicular to the flow direction of the refrigerant, the hook 253 of the first hook portion 251 is guided in the direction perpendicular to the flow direction of the refrigerant along the second guide 262. Thereafter, when the first hook portion 251 is hook-coupled to the second frame 242, the second guide 262 is insertedly coupled to the support groove 254 of the first hook portion 251, so that the coupling portion of the first and second assemblies 210 and 220 may be improved.

Since the first guide (not shown) of the first frame 241 has the same coupling configuration as that of the second guide 252, the description thereof will be omitted.

As described above, the frame 240 may be provided in a pair. Accordingly, each of the first and second frames 241 and 242 may also be provided in a pair.

For the sake of convenience of description, one of the pair of frames disposed on the right side with respect to the flow direction of the refrigerant is referred to as a right frame 241*a* or 242*a*, and the other one of the pair of frames disposed on the left side is referred to as a left frame 241*b* or 242*b*. The plurality of hooks 253 of the second hook portion 252 may be alternately disposed on the left side second frame 242*b* and the right side second frame 242*a* while being spaced apart from each other sequentially in the flow direction of the refrigerant.

That is, when the hook 253 which is the closest to the refrigerant inlet 111*a* is disposed on the left side second frame 242*b*, the hook 253 which is the second closest to the refrigerant inlet 111*a* is disposed on the right side second frame 242*a*, and the hook 253 which is the third closest to the refrigerant inlet 111*a* may be disposed on the left side second frame 242*b*.

Similarly, the second guides 262 may be alternately disposed on the left side second frame 242*b* and the right side second frame 242*a* while being spaced apart from each other in the flow direction of the refrigerant, respectively.

When the second guide 262 which is the closest to the refrigerant inlet 111*a* is disposed on the right side second frame 242*a*, the second guide 262 which is the second closest to the refrigerant inlet 111*a* is disposed on the left side second frame 242*b*, and the second guide 262 which is the third closest to the refrigerant inlet 111*a* may be disposed on the right side second frame 242*b*.

The second guides 262 and the hooks 253 of the second hook portion 252 may be alternately disposed. Accordingly, the second guide 262 and the hook 253 of the second hook portion 252 may be disposed at corresponding positions in the left-right direction.

Since the first guide (not shown) and the hook 253 of the first hook portion 251 disposed on the first frame 241 are also disposed in the same manner as the second guide 262 and the hook 253 of the second hook portion 252, and thus description thereof will be omitted. However, the hook 253 of the first hook portion 251 which is the closest to the refrigerant inlet 111*a* may be disposed on the right side first frame 241*a*, and the first guide (not shown) which is the closest to the refrigerant inlet 111*a* may be disposed on the left side first frame 241*a*.

Accordingly, when the first and second assemblies 210 and 220 are coupled to each other, the first hook portion 251 may be coupled to the second guide 262, and the second hook portion 252 may be coupled to the first guide (not shown).

The first and second assemblies 210 and 220 may each have the same shape. In this case, the second assembly 220 may be the same as the first assembly 210 which is rotated 180 degrees in the circumferential direction of the plurality of baffles 230. Accordingly, a plurality of the single-shape assemblies may be manufactured and coupled to each other so that the structure body 200 may be formed.

Each of the plurality of baffles 230 may include a first surface 234 (FIG. 5) facing in the flow direction of the refrigerant. The first surface 234 is a part that collides with the refrigerant introduced. Each of the first surfaces 234 may include a first inclined portion 236 formed to be inclined from the hole 233 toward the outside of the first surface 234 in the flow direction of the refrigerant.

As described above, the holes 233 are disposed in the center of the plurality of baffles 230. Accordingly, a side of the hole 233 has the largest thickness and a side of the outer circumferential surface has the smallest thickness in the plurality of baffles 330.

Each of the plurality of baffles 230 may include a second surface 235 disposed on a side opposite to the first surface 234. Each of the second surfaces 235 may include a second inclined portion 237 formed to be inclined from the hole 233 toward the outside of the second surface 235 in the flow direction of the refrigerant.

The first and second surfaces 234 and 235 may be symmetrically disposed with respect to the direction perpendicular to the flow direction of the refrigerant. Accordingly, each of the plurality of baffles 330 may be symmetrically formed with respect to the direction perpendicular to the flow direction of the refrigerant.

Accordingly, when the structure body 200 is inserted into the internal space 115, the structure body 200 may be inserted into the housing 110 in the same shape regardless of the insertion direction according to whether the first baffle 230*a* is first inserted, or the eleventh baffle 230*k* is inserted first. Therefore, the installation of the structure body 200 may be improved.

The plurality of baffles 230 may partition the internal space 115 in the flow direction of the refrigerant. The first baffle 230*a* and the second baffle 230*b* may form a first internal space 116*a* which is the closest to the refrigerant inlet 111*a*, and the second baffle 230*b* and the third baffle 230*c* may form a second inner surface 116*b* followed by the first inner surface 116*a* which is the second closest to the refrigerant inlet 111*a*. In this way, the unit internal spaces 116 may be partitioned in different numbers according to the number of the plurality of baffles 230.

Hereinafter, a technical feature of stabilizing the refrigerant by the noise reduction device 100 will be described in detail.

Figure 6:
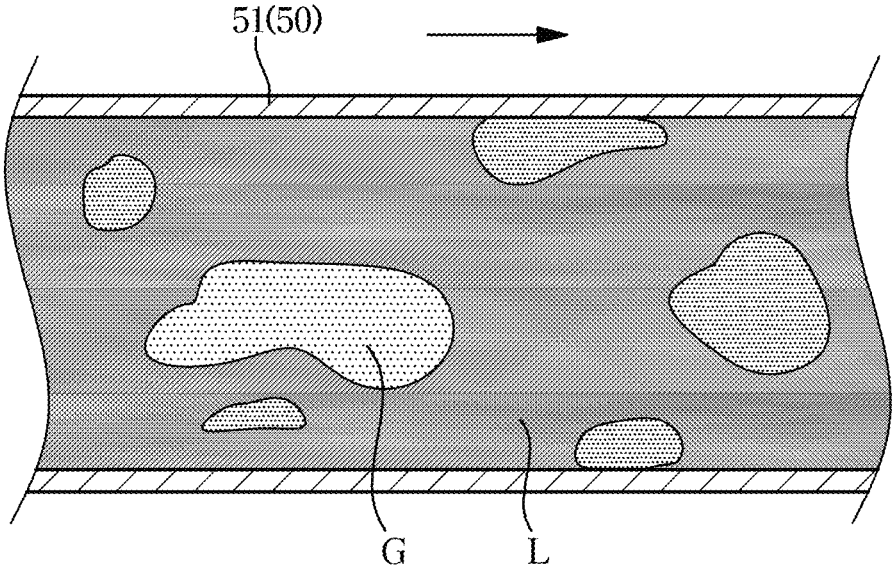
FIG. 6 is a view schematically illustrating a refrigerant flowing in a refrigerant pipe before flowing into the noise reduction device shown in FIG. 2.
Figure 7:
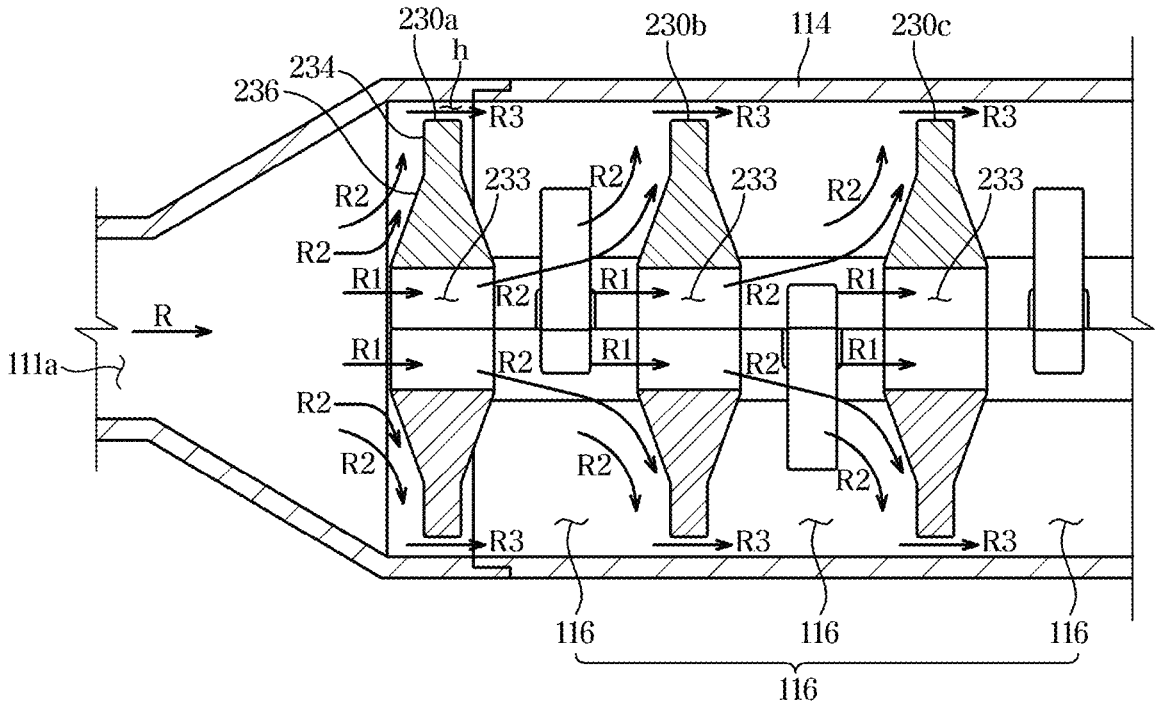
FIG. 7 is a cross-sectional view illustrating a part of the noise reduction device shown in FIG. 2.
Figure 8:
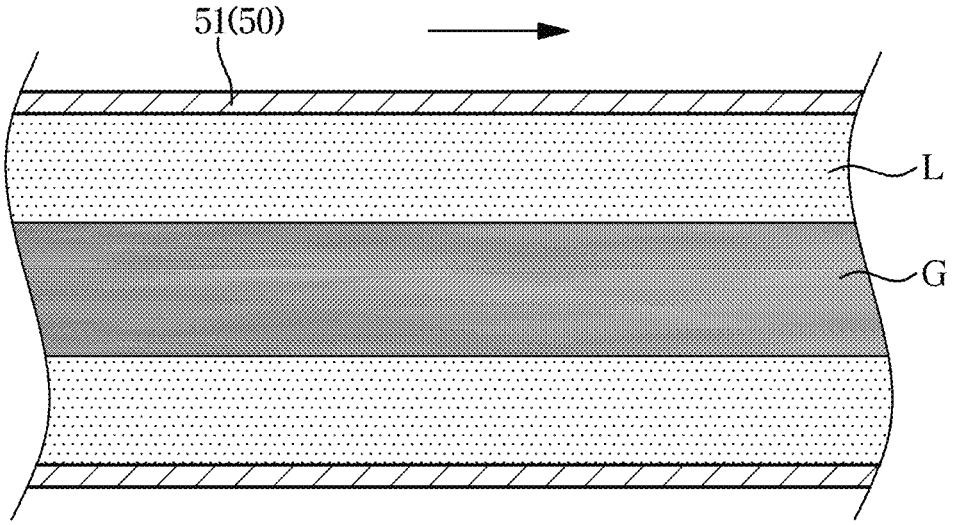
FIG. 8 is a view schematically illustrating a refrigerant flowing in the refrigerant pipe after passing through the noise reduction device shown in FIG. 2.

FIG. 6 is a view schematically illustrating a flow of a refrigerant in a refrigerant pipe before flowing into the noise reduction device shown in FIG. 2, FIG. 7 is a cross-sectional view illustrating a part of the noise reduction device shown in FIG. 2, and FIG. 8 is a view schematically illustrating a flow of a refrigerant in the refrigerant pipe after passing through the noise reduction device shown in FIG. 2.

Referring to FIG. 6, the refrigerant inside the first pipe 51 may have an irregular flow before flowing into the noise reduction device 100. The refrigerant may be formed as a two-phase refrigerant of a gas phase G and a liquid phase L. Since the flow velocity of the gas phase G is faster than that of the liquid L, the gas phase G included in the liquid phase L irregularly flows inside the liquid phase L, causing noise inside the refrigerant pipe 50 and the indoor heat exchanger 40. The gas phase G irregularly colliding with the refrigerant pipe 50 or the indoor heat exchanger 40, or irregularly passing through the refrigerant pipe 50 or the indoor heat exchanger 40 may cause vibration, which results in noise inside the refrigerant pipe 50 and the indoor heat exchanger 40.

Referring to FIG. 7, when a refrigerant R flows into the noise reduction device 100, the refrigerant R may collide with the first baffle 230*a*. As described above, the hole 233 is formed in the center side of the first baffle 230*a*, and a refrigerant R1 among the refrigerants R which has a high flow rate first passes through the hole 233 and flows into the first internal space 116*a*. The refrigerant R1 having a high flow rate may directly flow into the hole 233 without colliding with the first surface 234.

A refrigerant R2 having a relatively low flow rate may not flow into the hole 233 and collide with the first surface 234 and then flow into the hole 233 later than the refrigerant R1 having a high flow rate.

In addition, a refrigerant R3 among the refrigerants R2 having a low flow rate may collide with the first surface 234 and pass through a gap h formed between the plurality of baffles 230 and the inner circumferential surface 114 and then flow into the first internal space 115*a*.

As described above, since the gas phase G has a higher flow rate than the liquid phase L, the refrigerant R1 having a high flow rate may be mainly formed of a gas phase G. However, some liquid phase L may also be included in the fast refrigerant R1 together with the gas phase G and pass through the hole 233.

The slow refrigerant R2 may be mainly formed of a liquid phase L. However, some gas phase G may also be included in the slow refrigerant R2, and the gas phase G included in the slow refrigerant R2 may collide with the first surface 234 but pass through the hole 233 faster than the liquid phase L in the slow refrigerant R2.

The first inclined portion 246 of the first surface 234 may cause the slow refrigerant R2 colliding with the first surface 234 to flow to the opposite side, inducing an additional collision. That is, the first inclined portion 236 may diversify the collision angle of the refrigerant R so that the refrigerant R is induced to have more collisions within the unit internal space 116, thereby constraining the slow refrigerant R2 from flowing into the hole 233 other than the fast refrigerant R1.

Thereafter, the fast refrigerant R1 among the refrigerants R introduced into the first internal space 116*a* may first flow into the second internal space 116*b* through the hole 233 of the second baffle 230*b*. In addition, the slow refrigerant R2 among the refrigerants R introduced into the first internal space 116*a* may collide with the first surface 234 of the second baffle 230*b* and flow into the hole 233 or may pass through the gap h and flow into the second internal space 116*b* later than the fast refrigerant R1.

As the plurality of baffles 230 is provided in plural, the unit internal space 116 is formed in plural, so that the above-described process may be continuously repeated. Accordingly, the refrigerant R may be rectified such that the fast refrigerant R1 is guided to flow along the center side in the flow direction of the refrigerant, and the slow refrigerant R2 flows along outside the fast refrigerant R1.

As described above, the plurality of baffles 330 may induce the refrigerant R such that the fast refrigerant R1 intensively flows along the center side. Since the fast refrigerant R1 is mainly formed of a gas phase G as described, the refrigerate R flows such that the gas phase G flowing in an irregularly scattered state is caused to be located only at the center side.

Therefore, as shown in FIG. 8, the refrigerant R may be regularly divided into two phases and flow in the form in which the rapidly flowing gas phase G is disposed at the center side of the refrigerant R in the flow direction of the refrigerant, and the liquid phase L is provided outside the gas phase G by surrounding the gas phase G.

That is, the refrigerant R flowing in a slug flow shape, while passing through the noise reduction device 100, is subject to phase separation to form a stable state, particularly, an annular flow state in which a gas phase G is located in the center and a liquid phase L is located around the gas phase G.

The plurality of baffles 230 may be sequentially disposed while being spaced apart from each other at positions corresponding to each other in the flow direction of the refrigerant. In addition, the holes 233 of the plurality of baffles 230 may also be sequentially disposed while being spaced apart from each other at positions corresponding to each other in the flow direction of the refrigerant. Accordingly, the gas phase G may be more efficiently located in the center of the refrigerant R. This is because when some of the holes of the plurality of baffles 230 are not disposed in the positions corresponding to other holes in the flow direction of the refrigerant, the gas phase G passed through the center portion may collide with some baffles and to be scattered, failing to form an annular flow.

As described above, the noise reduction device 100 allows a gas phase G and a liquid phase L of the refrigerant R to be uniformly divided and flow, so that the flow of the refrigerant R may be stabilized even when the internal space 115 is small.

Hereinafter, a structure body 300 of the noise reduction device 100 according to another embodiment of the disclosure will be described. Components other than the structure body 300 to be described below are the same as those of the noise reduction device 100 according to the above-described embodiment, and thus descriptions thereof will be omitted.

Figure 9:
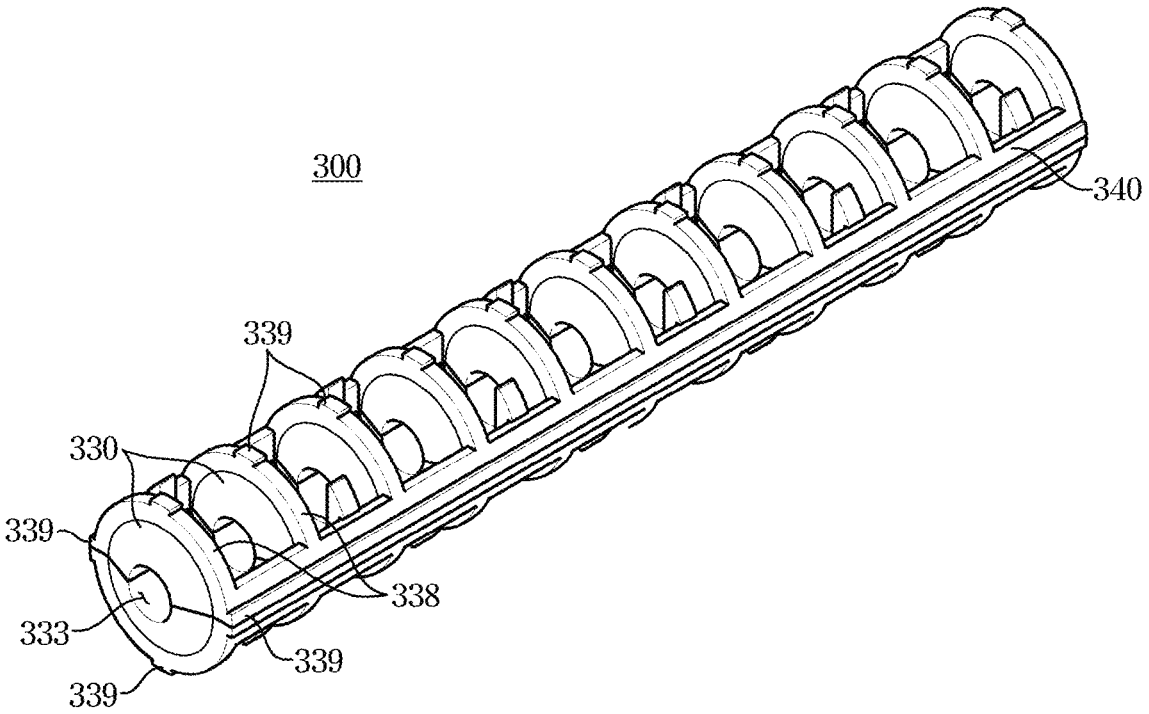
FIG. 9 is a perspective view illustrating a structure body of a noise reduction device of an air conditioner according to another embodiment of the disclosure.
Figure 10:
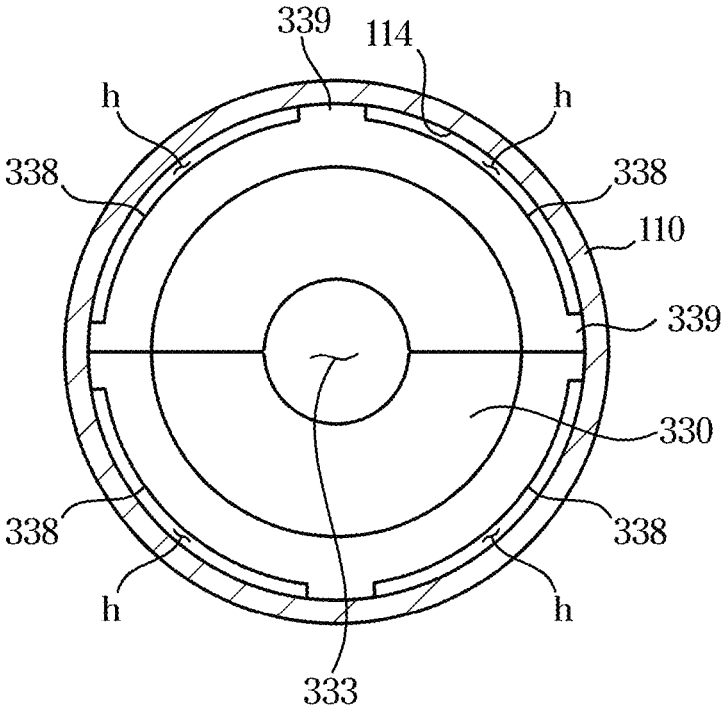
FIG. 10 is a cross-sectional view illustrating a noise reduction device of an air conditioner according to another embodiment of the disclosure.

FIG. 9 is a perspective view illustrating a structure body of a noise reduction device a noise reduction device of an air conditioner according to another embodiment of the disclosure, and FIG. 10 is a cross-sectional view illustrating a noise reduction device of an air conditioner according to another embodiment of the disclosure.

Referring to FIGS. 9 and 10, a plurality of baffles 330 each have a rib 339 provided on an outer circumferential surface 338 thereof to come into contact with the inner circumferential surface 114 of the housing 110. Each rib 339 may be provided to protrude outward in the radial direction of the plurality of baffles 330 on the outer circumferential surface 338. Each rib 339 may be provided in plural. The plurality of ribs 339 may be disposed while being spaced apart from each other along the outer circumferential surface 338 of a corresponding one of the plurality of baffles 330.

A gap h may be formed between the inner circumferential surface 114 and the plurality of baffles 330 to correspond to a height at which the rib 339 protrudes from the outer circumferential surface 338. That is, the rib 339 may be provided to form a gap h between the inner circumferential surface 114 and the plurality of baffles 330 such that a part of the slow refrigerant R2 flows along the gap h. Although a gap h may be formed between the plurality of baffles 230 and the inner circumferential surface 114 according to the previous embodiment of the disclosure, the gap h is an installation gap formed to insert the structure body 200 into the housing 110.

However, the plurality of baffles 330 according to the embodiment of the disclosure may include the rib 339 so that the area of the gap h becomes larger, which causes the amount of the refrigerant R3 flowing through the gap h among the refrigerants R to be increased, and the flowability of the refrigerant R in the noise reduction device 100 to be improved. In this case, since the refrigerant R3 flowing through the gap h is mainly formed of a liquid phase L as described above, even when the gap h is large, the liquid phase L and the gas phase G are not inhibited from being separately guided.

Hereinafter, a structure body 400 of the noise reduction device 100 according to another embodiment of the disclosure will be described. Components other than the structure body 400 to be described below are the same as those of the noise reduction device 100 according to the above-described embodiment, and descriptions thereof will be omitted.

Figure 11:
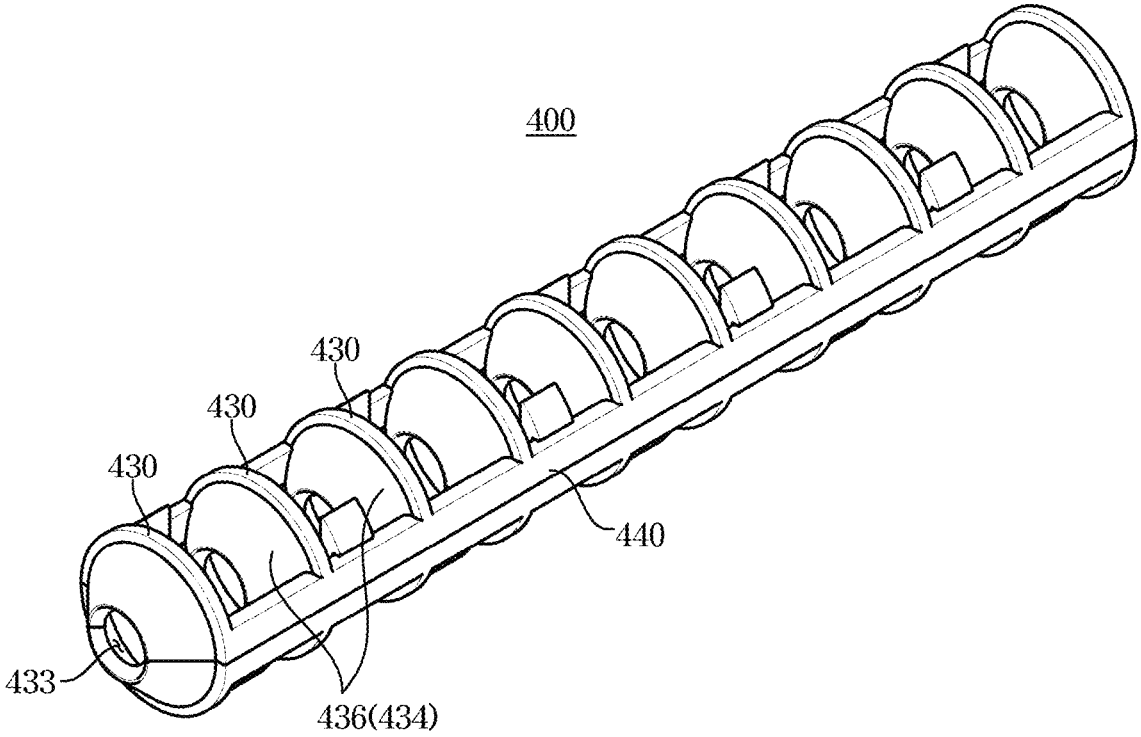
FIG. 11 is a perspective view illustrating a structure body of a noise reduction device of an air conditioner according to another embodiment of the disclosure.
Figure 12:
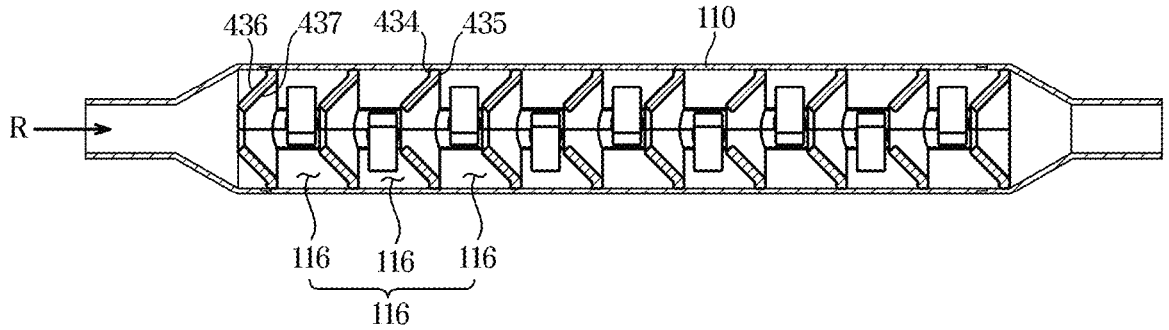
FIG. 12 is a longitudinal sectional view illustrating a noise reduction device of an air conditioner according to another embodiment of the disclosure.

FIG. 11 is a perspective view illustrating a structure body of a noise reduction device of an air conditioner according to another embodiment of the disclosure, and FIG. 12 is a longitudinal sectional view illustrating a noise reduction device of an air conditioner according to another embodiment of the disclosure.

Referring to FIGS. 11 and 12, a first surface 434 and a second surface 435 of each of a plurality of baffles 440 are not symmetrically formed with respect to the direction perpendicular to the flow direction of the refrigerant, but are parallel to each other. That is, a first inclined portion 436 of the first surface 434 and a second inclined portion 437 of the second surface 435 may be formed to be inclined in the same direction.

Accordingly, the first inclined portion 436 may be formed to have more various angles than the first inclined portion 236 of the structure body 200 according to the previous embodiment of the disclosure. The second inclined portion 237 of the structure body 200 according to the previous embodiment of the disclosure is inclined in a direction opposite to that of the first inclined portion 236, so that the unit internal space 116 of the internal space 115 partitioned by the structure body 200 may be narrow.

This is because the first inclined portion 236 and the second inclined portion 237 are provided to protrude in a direction in which the unit internal space 116 become narrower, from a perspective of the unit internal space 116.

However, the first inclined portion 436 and the second inclined portion 437 of the structure body 400 according to the embodiment of the disclosure are arranged in parallel, so that the unit internal space 116 may be uniformly formed regardless of the inclination angle of each of the first and second inclined portion 436 and 437.

Therefore, the inclination angles of the first inclined portion 436 and the second inclined portion 437 may be set to an angle optimized such that the slow refrigerant R2 is caused to flow after sufficiently colliding inside the unit internal space 116 without being limited by the size of the unit internal space 116.

Hereinafter, a structure body 500 of the noise reduction device 100 according to another embodiment of the disclosure will be described. Components other than the structure body 500 to be described below are the same as those of the noise reduction device 100 according to the above described embodiment, and thus descriptions thereof will be omitted.

Figure 13:
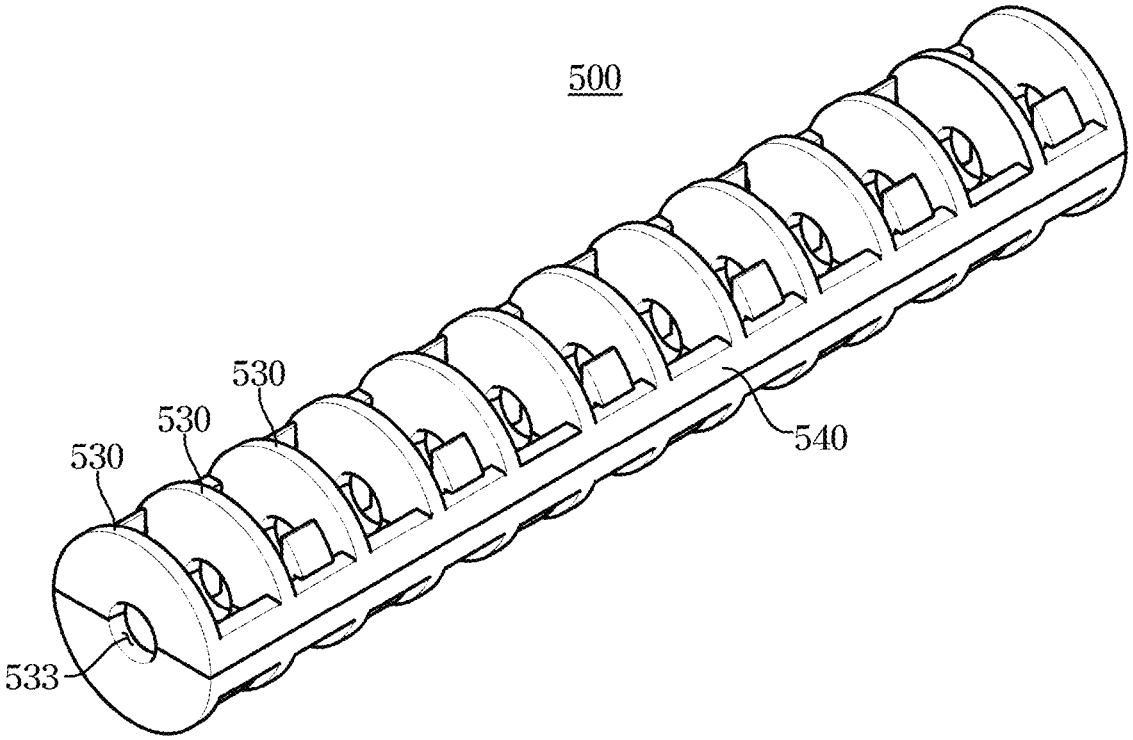
FIG. 13 is a perspective view illustrating a structure body of a noise reduction device of an air conditioner according to another embodiment of the disclosure.
Figure 14:
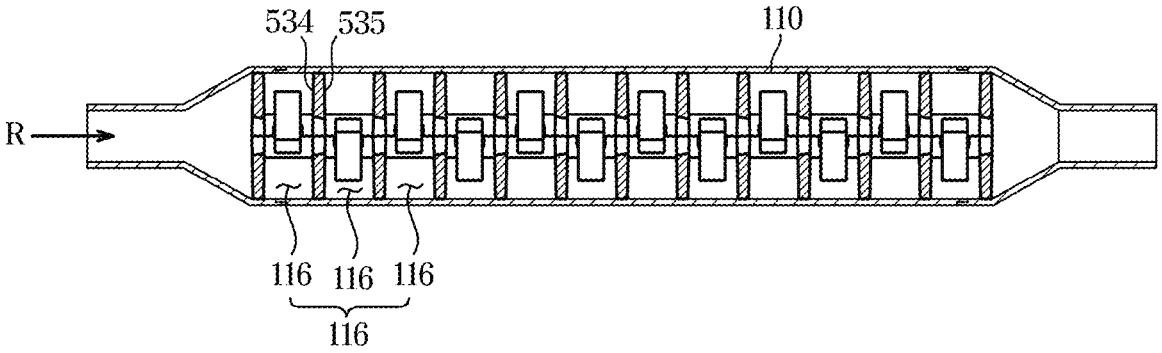
FIG. 14 is a longitudinal cross-sectional view illustrating a noise reduction device of an air conditioner according to another embodiment of the disclosure.

FIG. 13 is a perspective view illustrating a structure body of a noise reduction device of an air conditioner according to another embodiment of the disclosure, and FIG. 14 is a longitudinal cross-sectional view illustrating a noise reduction device of an air conditioner according to another embodiment of the disclosure.

Referring to FIGS. 13 and 14, a first surface 534 and a second surface 535 of each of a plurality of baffles 530 may be formed in a direction perpendicular to the flow direction of the refrigerant. That is, the first surface 534 and the second surface 535 may not include an inclined portion. When it is considered that sufficient collision may occur in the unit internal space 116 even when the first surface 534 or the second surface 535 does not include an inclined portion based on the flow rate of the refrigerant, the first surface 534 or the second surface 535 may not include an inclined portion.

Hereinafter, a structure body 600 of the noise reduction device 100 according to another embodiment of the disclosure will be described. Components other than the structure body 600 described below are the same as those of the noise reduction device 100 according to the above-described embodiment, and descriptions thereof will be omitted.

Figure 15:
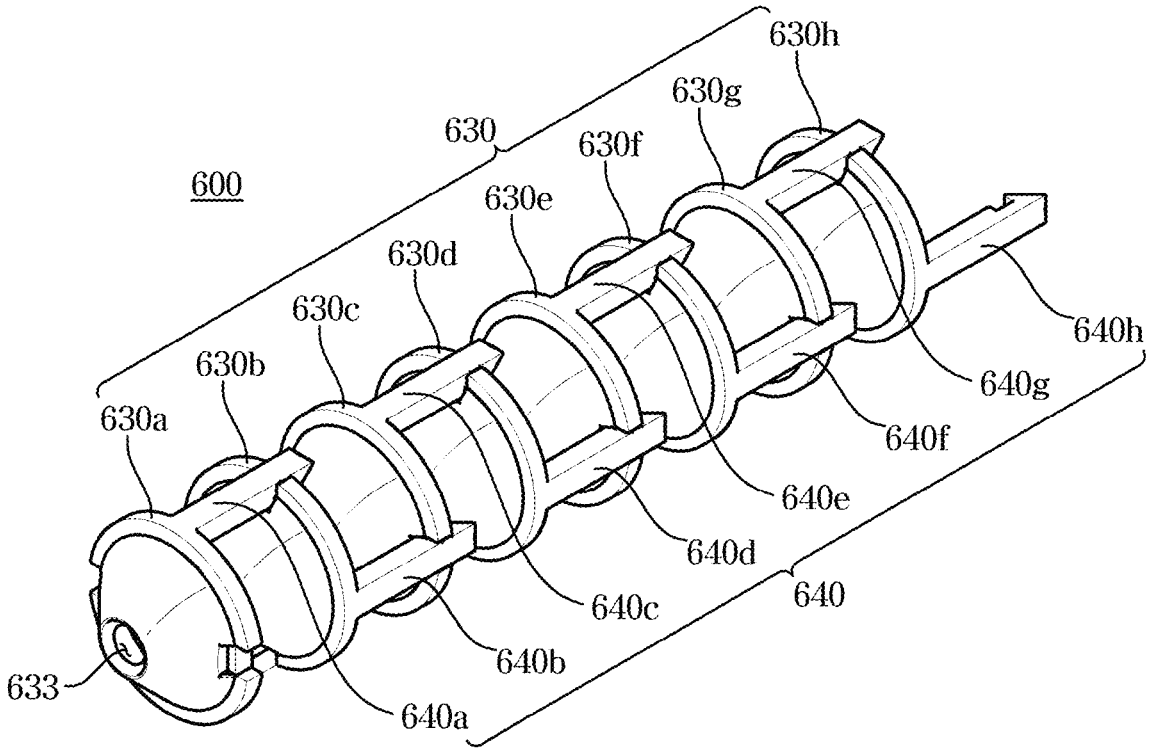
FIG. 15 is a perspective view illustrating a structure body of a noise reduction device of an air conditioner according to another embodiment of the disclosure.
Figure 16:
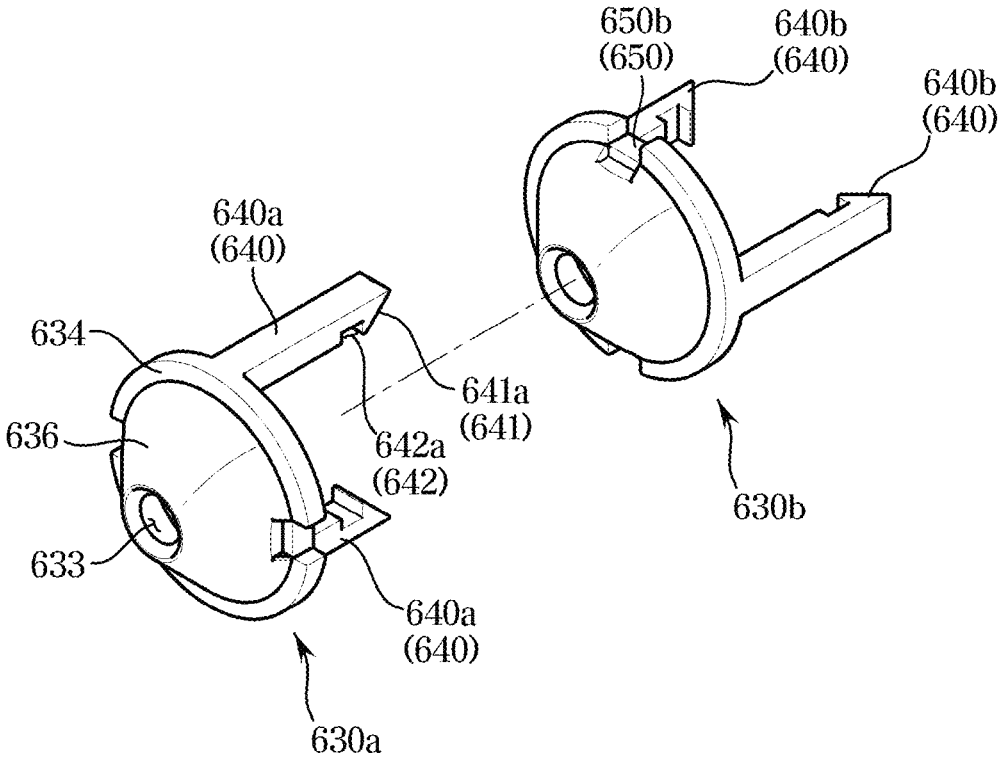
FIG. 16 is an exploded perspective view illustrating parts of a structure body of a noise reduction device of an air conditioner according to another embodiment of the disclosure.
Figure 17:
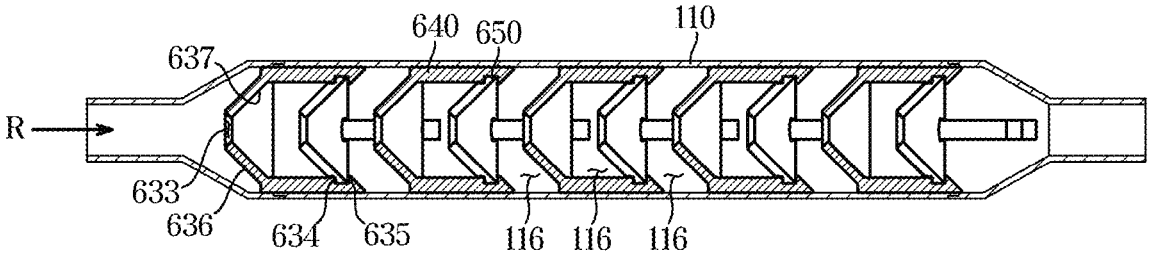
FIG. 17 is a longitudinal sectional view illustrating a noise reduction device of an air conditioner according to another embodiment of the disclosure.

FIG. 15 is a perspective view illustrating a structure body of a noise reduction device of an air conditioner according to another embodiment of the disclosure, FIG. 16 is an exploded perspective view illustrating parts of a structure body of a noise reduction device of an air conditioner according to another embodiment of the disclosure, and FIG. 17 is a longitudinal sectional view illustrating a noise reduction device of an air conditioner according to another embodiment of the disclosure.

Referring to FIGS. 15 to 17, a structure body 600 may include a plurality of baffles 630 and a plurality of frames 640 respectively formed on the plurality of baffles 630. Each of the plurality of frames 640 may be provided to protrude to the rear side of a first surface 634 of one of the plurality of baffles 630 corresponding thereto.

The first surfaces 634 may each include a first inclined portion 636 formed to be inclined from the hole 633 toward the outside of the first surface 634 in the flow direction of the refrigerant. However, the disclosure is not limited thereto, and the first surface 634 may be provided to be perpendicular to the flow direction of the refrigerant without including the first inclined portion 636.

A second surface 635 disposed at a side opposite to the first surface 634 may be disposed parallel to the first surface 634. In detail, the first surface 634 and the second surface 635 may be disposed in parallel with each other in the direction in which the refrigerant flows. However, the disclosure is not limited thereto, and the second surface 635 may be symmetrical to the first surface 634 with respect to the direction perpendicular to the direction in which the refrigerant flows.

The second surface 635 may include a second inclined portion 637 formed to be inclined toward the outside of the second surface 635 in the flow direction of the refrigerant. The second inclined portion 637 may be disposed parallel to the first inclined portion 636 in the direction in which the refrigerant flows. However, the disclosure is not limited thereto, and the second surface 636 may be provided to be perpendicular to the flow direction of the refrigerant without including the second inclined portion 637. In addition, the second inclined portion 637 may be symmetrical to the first inclined portion 636 about the direction perpendicular to the direction in which the refrigerant flows.

Hereinafter, among the plurality of baffles 630 and the plurality of frames 640, the first baffle 630*a* and the first frame 640*a* formed on the first baffle 630*a* and the second baffle 630*b* and the second frame 640*b* formed on the second baffle 630*b* are described as an example. Since all of the plurality of baffles 630 have the same shape, details of parts identical to each other will not be described.

The first frame 640*a* may be provided in a pair. However, the disclosure is not limited thereto, and the first frame 640*a* may be formed in three or more units thereof. The pair of first frames 640*a* may be disposed with a phase difference of approximately 180 degrees in the circumferential direction of the first baffle 630*a*. However, the disclosure is not limited thereto, and the pair of first frames 640*a* may be disposed with various phase differences.

The first frame 640*a* may include a first hook portion 641*a* that may be hooked to the second baffle 630*b* and a first fixing groove 642*a* to which the second baffle 630*b* is fixed. The first baffle 630*a* and the second baffle 630*b* may be coupled to each other in the flow direction of the refrigerant. That is, the first hook portion 641*a* is hook-coupled to the second baffle 630*b* in the flow direction of the refrigerant so that the first baffle 630*a* and the second baffle 630*b* may be coupled to each other. The second baffle 630*b* may include a second support groove 650*b* that is hook-coupled to the first hook portion 641*a* and fixed to and supported by the first fixing groove 642*a*. The first hook portion 641*a* is hook-coupled to the second support groove 650*b* so that the first baffle 630*a* and the second baffle 630*b* may be coupled to each other.

The second support grooves 650*b* may be provided corresponding in number to the number of the first frames 640*a*. Therefore, the second support groove 650*b* may be provided in a pair. The pair of second support grooves 650*b* may be disposed with a phase difference of approximately 180 degrees in the circumferential direction of the second baffle 630*b*. However, the disclosure is not limited thereto, and the pair of second support grooves 650*b* may be disposed with various phase differences.

The pair of second support grooves 650*b* may be disposed with a phase difference of approximately 90 degrees from the pair of second frames 640*b*, respectively, in the circumferential direction of and the second baffle 630*b*.

Accordingly, the first baffle 630*a* and the second baffle 630*b* may be coupled to each other with a phase difference of approximately 90 degrees in the circumferential direction of the first baffle 630*a*. That is, the first baffle 630*a* and the second baffle 630*b* are each provided in the same shape, and the second baffle 630*b* is coupled to the first baffle 630*a* in a position rotated by 90 degrees from the phase at which the first baffle 630*a* is disposed.

In addition, a third baffle 630*c* may be coupled to the second baffle 630*b* in the same phase as that of the first baffle 630*a*, and a fourth baffle 630*d* may be coupled to the third baffle 630*c* in the same phase as that of the second baffle 630*b*.

As such, the plurality of baffles 630 include the frames 640 coupled thereto, and the hook portion 641 and the fixing groove 642 formed on the frame 640 may be hook-coupled to one of the plurality of baffles 630 adjacent thereto.

Accordingly, the structure body 600 may be formed in various lengths in the flow direction of the refrigerant as needed. That is, when coupling a small number of baffles among the plurality of baffles 630 to each other, the length of the structure body 600 may become shorter, and when coupling a large number of baffles 630 among the plurality of baffles 630 to each other, the length of the structure body 600 may become longer to correspond to the number of the baffles 630 coupled to each other.

Further, as the unit baffles of the plurality of baffles 630 are all formed in the same shape, manufacturability may be improved.

Hereinafter, a structure body 700 of the noise reduction device 100 according to another embodiment of the disclosure will be described. Components other than the structure body 700 to be described below are the same as those of the noise reduction device 100 according to the above described embodiment, and thus descriptions thereof will be omitted.

Figure 18:
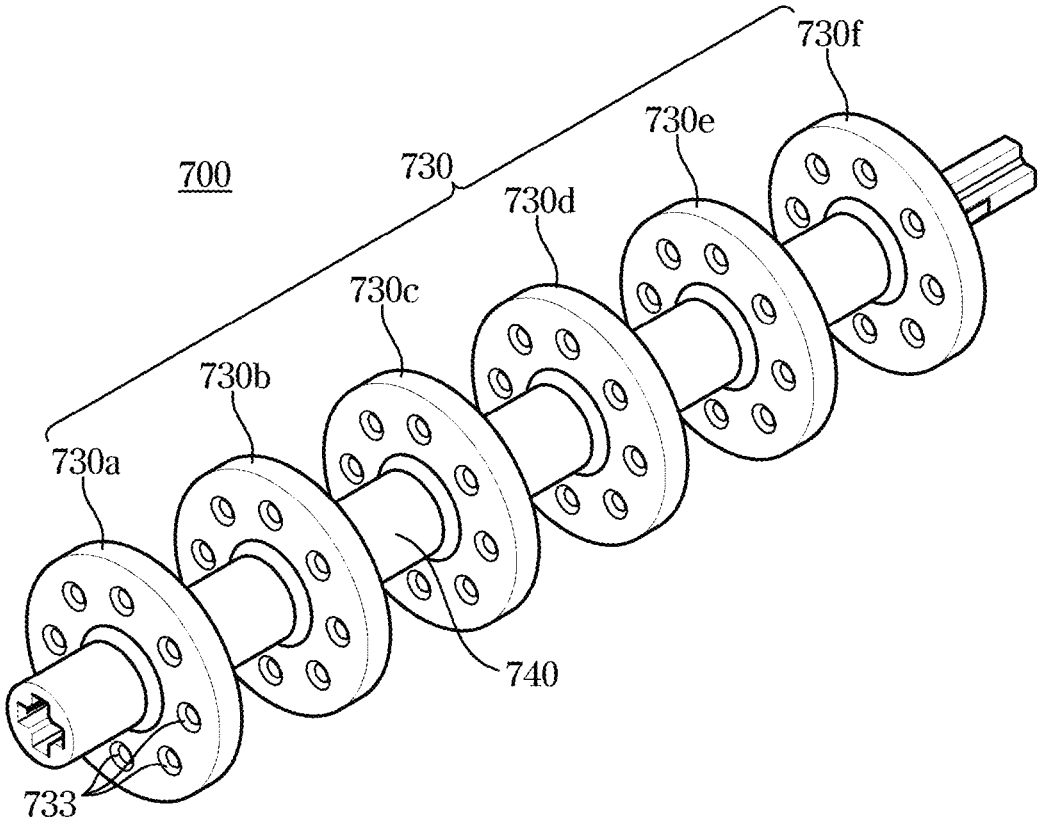
FIG. 18 is a perspective view illustrating a structure body of a noise reduction device of an air conditioner according to another embodiment of the disclosure.
Figure 19:
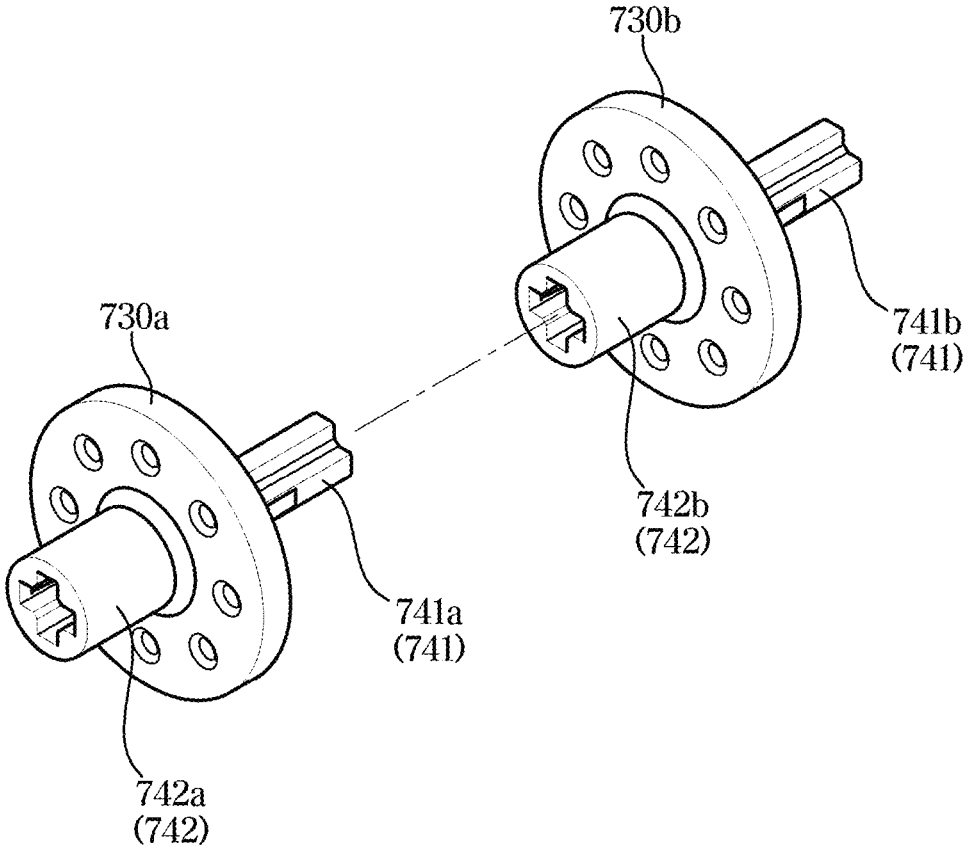
FIG. 19 is an exploded perspective view illustrating parts of a structure body of a noise reduction device of an air conditioner according to another embodiment of the disclosure.
Figure 20:
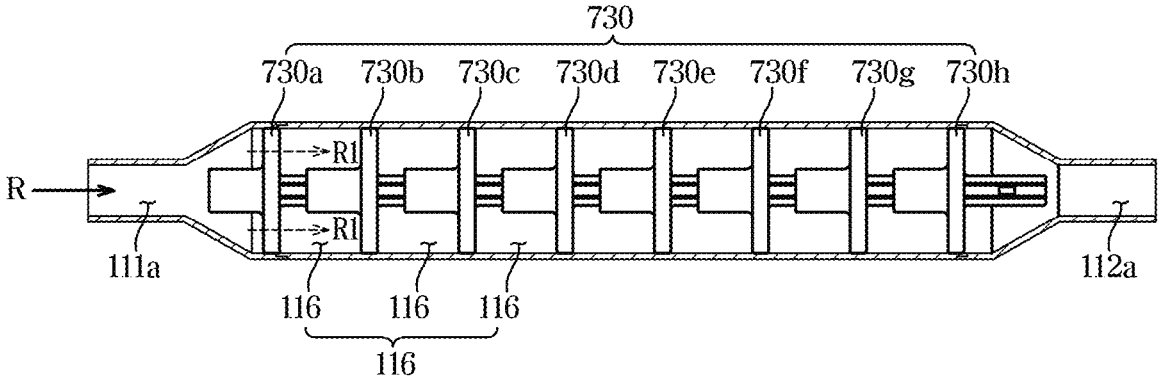
FIG. 20 is a longitudinal sectional view illustrating a noise reduction device of an air conditioner according to another embodiment of the disclosure.

FIG. 18 is a perspective view illustrating a structure body of a noise reduction device of an air conditioner according to another embodiment of the disclosure, FIG. 19 is an exploded perspective view illustrating parts of a structure body of a noise reduction device of an air conditioner according to another embodiment of the disclosure, and FIG. 20 is a longitudinal sectional view illustrating a noise reduction device of an air conditioner according to another embodiment of the disclosure.

The structure body 700 may include a plurality of baffles 730 and a frame 740 connecting the plurality of baffles 730 to each other. The plurality of baffles 730 may include holes 733 through which a refrigerant passes.

Unlike the above-described embodiments, a plurality of the holes 733 may be provided in each of the plurality of baffles 730. Also, unlike the above-described embodiments, the frame 740 may support the plurality of baffles 730 in the center sides of the plurality of baffles 730.

The following description is made in relation to a first baffle 730*a* and a second baffle 730*b* among the plurality of baffles 730 as an example. Since all of the plurality of baffles 730 are provided in the same form, parts identical to each other will be omitted.

The first baffle 730*a* may include a first insertion frame 741*a* forming the frame 740 and protruding from one side thereof and a first receive frame 742*a* protruding from a side opposite to the first insertion frame 741*a*.

The first baffle 730*a* may include a plurality of holes 733 disposed at an outside of the center in which the frame 740 is disposed. The plurality of holes 733 may be disposed while being spaced apart from each other in the circumferential direction of the first baffle 730. However, the disclosure is not limited thereto, and the plurality of holes 733 may be arranged in various ways.

The second baffle 730*b* may include a second insertion frame 741*b* forming the frame 740 and protruding from one side thereof and a second receive frame 742*b* protruding from a side opposite to the second insertion frame 741*b*.

The first insertion frame 741*a* of the first baffle 730*a* may be inserted into the second receive frame 742*b* of the second baffle 730*b*. As the first insertion frame 741*a* is inserted into the second receive frame 742*b*, the first baffle 730*a* and the second baffle 730*b* may be coupled to each other. In addition, a third baffle 730*c* may be coupled to the second baffle 730*b* in the same manner as the above. As such, the insertion frames 741 and the receive frames 742 formed on the plurality of baffles 730 may be coupled to each other to form the entire frame 740.

Accordingly, the structure body 700 may be formed in various lengths in the flow direction of the refrigerant as needed. That is, when coupling a small number of baffles among the plurality of baffles 730 to each other, the length of the structure body 700 may become shorter, and when coupling a large number of baffles 730 among the plurality of baffles 730 to each other, the length of the structure body 700 may become longer to correspond to the number of the baffles 730 coupled to each other.

In addition, as the unit baffles of the plurality of baffles 730 are all formed to have the same shape, the manufacturability may be improved.

The structure body 700 formed by coupling the plurality of baffles 730 to each other may be disposed inside the housing 110.

The plurality of baffles 730 may partition the internal space 115 of the housing 110.

Unlike the structure bodies 200, 300, 400, 500, and 600 described above, the structure body 700 according to the embodiment of the disclosure may stabilize the flow of the refrigerant by allowing the refrigerant R flowing into the noise reduction device 100 to be introduced into the partitioned internal space 115 and be mixed.

That is, the refrigerant R introduced through the refrigerant inlet 111*a* may collide with the first baffle 730*a* and be mixed between the refrigerant inlet 111*a* and the first baffle 730*a*, and then flow to the second baffle 730*b* through the plurality of holes 733 of the first baffle 730*a*.

The refrigerant in an unstable flow state forming a slug flow is introduced into the refrigerant inlet 111*a* and primarily mixed between the refrigerant inlet 111*a* and the first baffle 730*a*. Thereafter, a mixed refrigerant R1 may be introduced into a first internal space 116*a* through the plurality of holes 733 of the first baffle 730*a*.

The mixed refrigerant R1 is secondarily mixed while colliding with the second baffle 730*b* in the first internal space 116*a* formed by the first baffle 730*a* and the second baffle 730*b*. Thereafter, the mixed refrigerant R1 may sequentially pass through a plurality of unit internal spaces 116 including a second internal space 116*b* and a third internal space 116*c* so that the flow thereof is stabilized That is, the gas phase of the slug flow is destroyed through the mixing, so that the flow may be stabilized. Accordingly, the refrigerant flowing out of the refrigerant outlet 112*a* may have a uniform mixture of a gas layer G and a liquid layer L and generate uniform vibration, so that noise is reduced.

However, the disclosure is not limited thereto, and the structure body 700 may include a hollow formed inside the frame 740. Although not shown in the drawing, the frame 740 may include hollows provided to communicate the plurality of insertion frames 741 with the plurality of receive frames 742.

Accordingly, when the plurality of insertion frames 741 are assembled with the plurality of receive frames 742, the frame 740 may include the hollow formed therein. When the hollow is formed in the frame 740 as such, a gas layer G of the refrigerant flowing into the housing 110 may flow through the hollow of the frame 740, and a liquid layer L of the refrigerant may flow through the plurality of holes 733, thereby achieving phase separation of the refrigerant.

Such a phase separation method corresponds to the method of separating phases of the refrigerant R by the structure bodies 200, 300, 400, 500, and 600 according to one embodiment or other embodiments of the disclosure.

Hereinafter, a structure body 800 of a noise reduction device according to another embodiment of the disclosure will be described. Components other than the structure body 800 to be described below are the same as those of the noise reduction device 100 according to the above-described embodiment, and thus descriptions thereof will be omitted.

Figure 21:
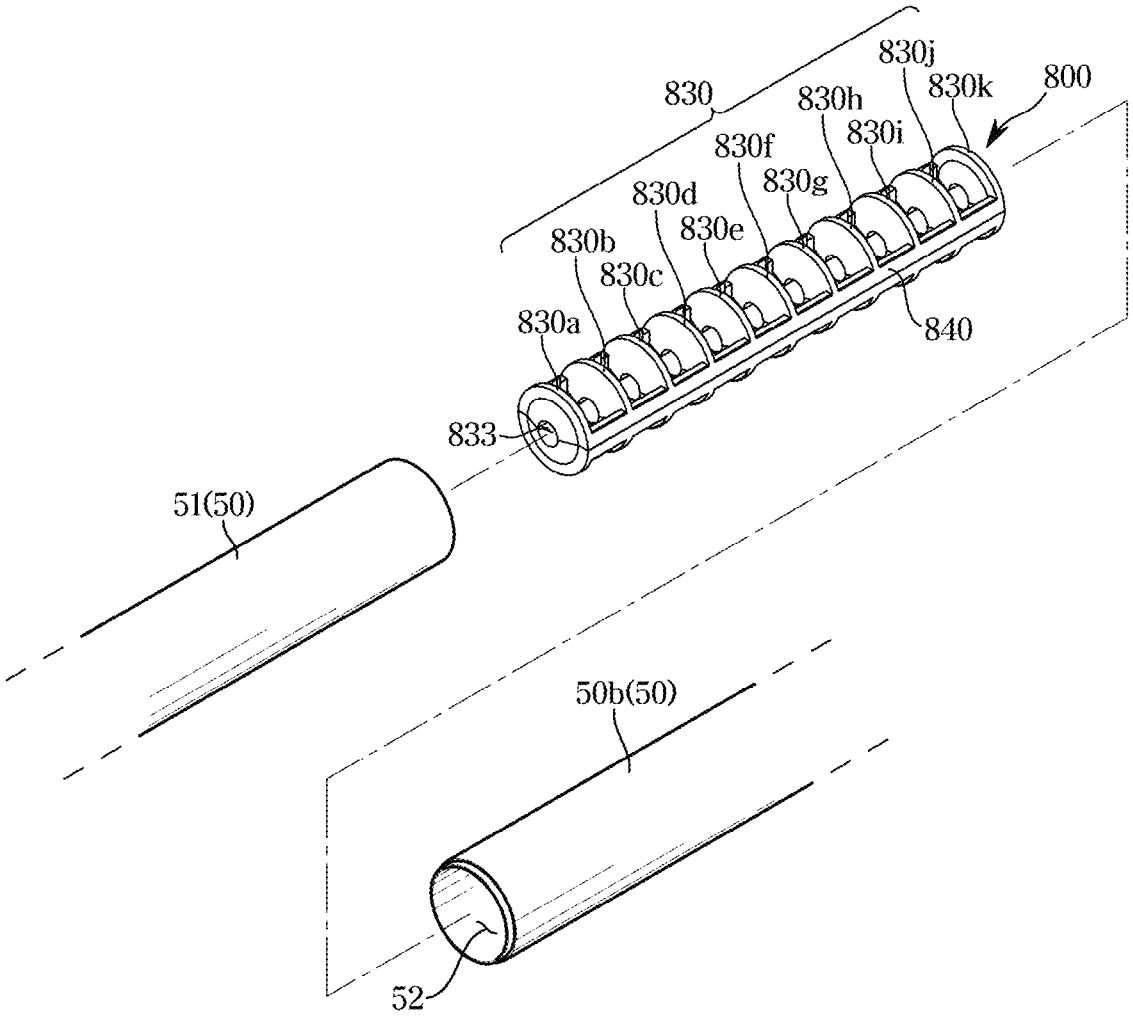
FIG. 21 is an exploded perspective view illustrating a noise reduction device and a refrigerant pipe of an air conditioner according to another embodiment of the disclosure.
Figure 22:
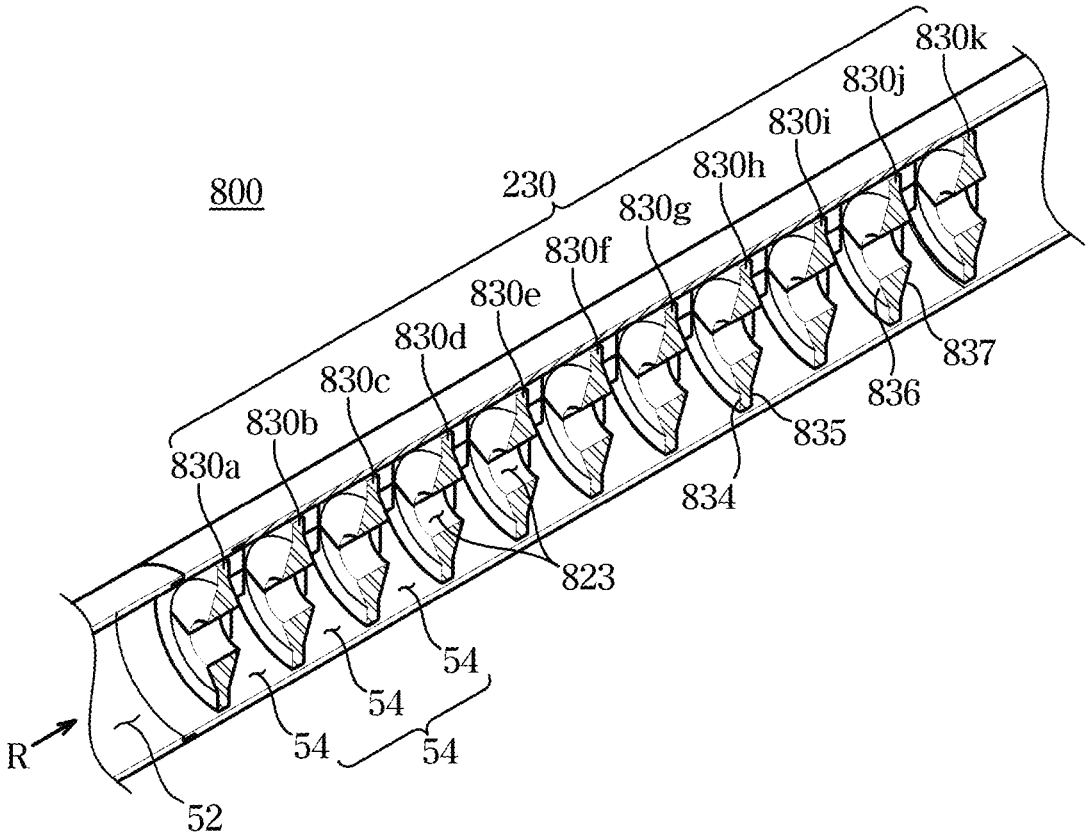
FIG. 22 is a longitudinal cross-sectional view illustrating a noise reduction device and a refrigerant pipe of an air conditioner according to another embodiment of the disclosure.

FIG. 21 is an exploded perspective view illustrating a noise reduction device and a refrigerant pipe of an air conditioner according to another embodiment of the disclosure, and FIG. 22 is a longitudinal cross-sectional view illustrating a noise reduction device and a refrigerant pipe of an air conditioner according to another embodiment of the disclosure.

Referring to FIGS. 21 and 22, the noise reduction device according to the embodiment of the disclosure may be formed of only a structure body 800 without including a housing.

The structure body 800 may be provided to be inserted into the inside 52 of the refrigerant pipe 50.

An outer circumferential surface of the structure body 800 may be provided to have a size substantially corresponding to the inner diameter of the refrigerant pipe 50.

The refrigerant pipe 50 includes a first pipe 51 connected to the expansion device 30 and a second pipe 50*b* coupled to the first pipe 51 and connected to the indoor heat exchanger 40. The first pipe 51 and the second pipe 50*b* may be coupled to each other through welding or the like.

The structure body 800 may be inserted into the inside 52 of the second pipe 50*b* before the first pipe 51 and the second pipe 50*b* are coupled to each other. However, the disclosure is not limited thereto and the structure body 800 may be inserted into the first pipe 51. After the structure body 800 is inserted into the inside 52 of the first pipe 51 or the second pipe 50*b*, the first pipe 51 or the second pipe 50*b* may be coupled to the structure 800.

Although not shown, the structure body 800 may include a coupling portion (not shown) coupled to the inside of the refrigerant pipe 50 such that the structure 800 inserted into the refrigerant pipe 50 is kept in position.

The coupling portion (not shown) may have a diameter formed larger than a radius of the inside 52 of the refrigerant pipe 50 by a predetermined length so as to be fitted into the inside 52 of the refrigerant pipe 50. However, the disclosure is not limited thereto, and the coupling portion (not shown) may be provided in various shapes. Accordingly, the structure body 800 may partition the inside 52 of the refrigerant pipe 50 into a plurality of unit spaces 54.

A plurality of baffles 830 of the structure body 800 may partition the inside 52 of the refrigerant pipe 50 into the plurality of unit spaces 54.

In this case, the structure body 800 may be formed in a shape corresponding to any one of the structure body 200 according to one embodiment of the disclosure and the structure bodies 300, 400, 500, 600, and 700 according to other embodiment of the disclosure described above.

Accordingly, a refrigerant flowing through the first pipe 51 may move in a slug flow state, but through the structure body 800, in which phases of the refrigerant are separated, the refrigerant may pass through the second pipe 50*b* in an annular flow state and then flow into the indoor heat exchanger 40.

Hereinafter, a noise reduction device 900 according to another embodiment of the disclosure will be described according to another embodiment of the disclosure. Configurations other than the noise reduction device 900 described below are the same as those of the noise reduction device 100 according to the above-described embodiment, and thus descriptions thereof will be omitted.

Figure 23:
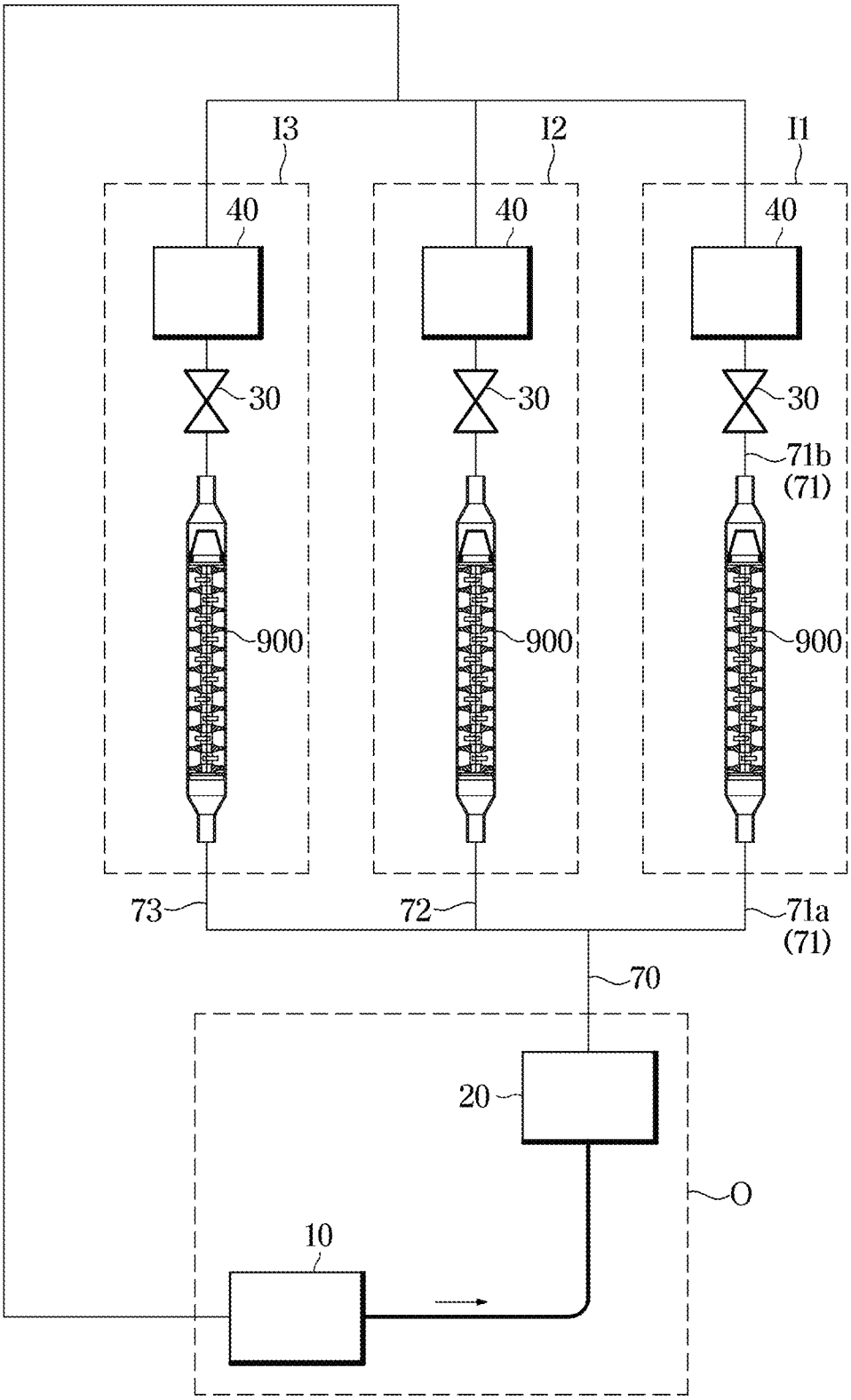
FIG. 23 is a view illustrating a refrigerant flow path of an air conditioner according to another embodiment of the disclosure.
Figure 24:
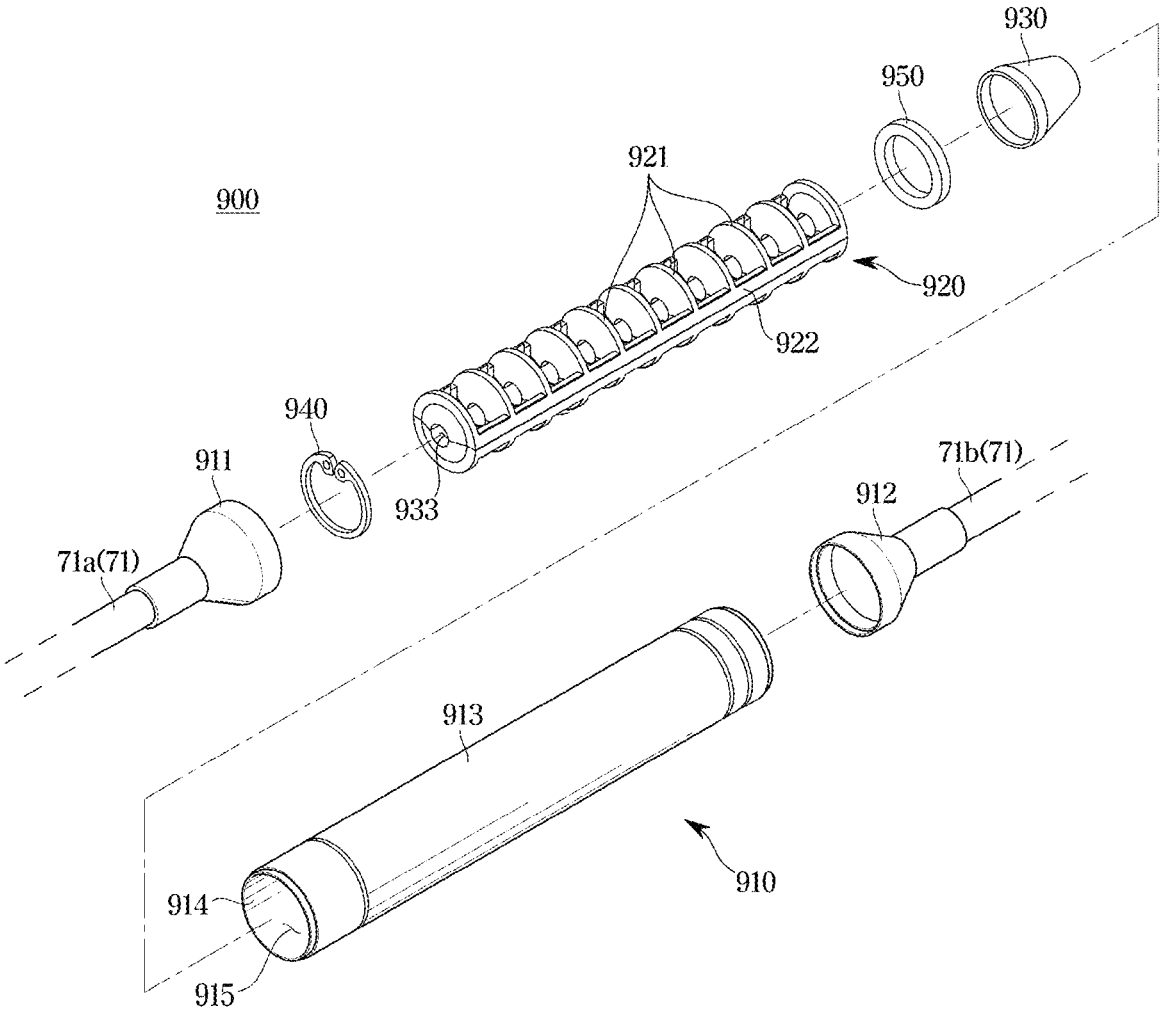
FIG. 24 is an exploded perspective view illustrating a noise reduction device shown in FIG. 23.
Figure 25:
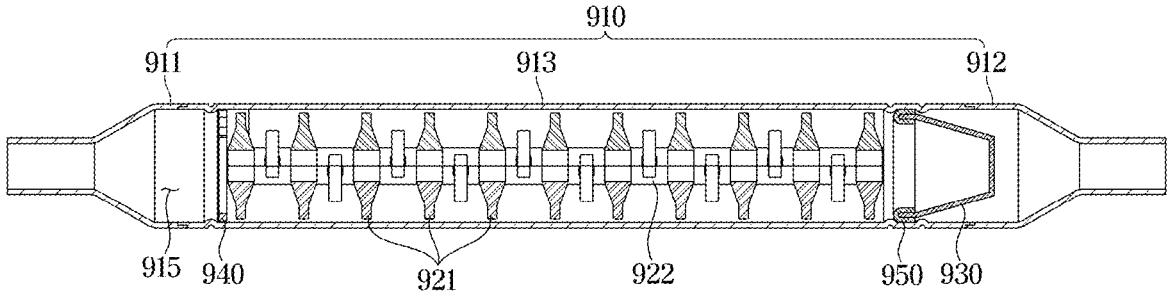
FIG. 25 is a cross-sectional perspective view illustrating the noise reduction device shown in FIG. 23.

FIG. 23 is a view illustrating a refrigerant flow path an air conditioner according to another embodiment of the disclosure, FIG. 24 is an exploded perspective view illustrating a noise reduction device shown in FIG. 23, and FIG. 25 is a cross-sectional perspective view illustrating the noise reduction device shown in FIG. 23.

Referring to FIG. 23, an air conditioner 1 may have a plurality of indoor units I1, I2, and I3 connected to a single outdoor unit O. The disclosure is not limited thereto, and the plurality of indoor units I1, I2, and I3 may include four or more indoor units.

Inside the outdoor unit O, a compressor 10 and an outdoor heat exchanger 20 may be disposed.

An expansion device 30, an indoor heat exchanger 40, and a noise reduction device 900 may be disposed in each of the plurality of indoor units I1, I2, and I3

The configurations may be connected to each other through a refrigerant pipe 70. The refrigerant pipe 70 may be branched into a number of pipes corresponding to the number of the plurality of indoor units I1, I2, and I3. The refrigerant pipe 70 may include a first pipe 71, a second pipe 72, and a third pipe 73 respectively connected to a first indoor unit I1, a second indoor unit I2, and a third indoor unit I3 among the plurality of indoor units I1, I2, and I3.

Although not shown in the drawing, the refrigerant pipe 70 may include a refrigerant valve (not shown) formed to allow a refrigerant to selectively flow through the first, second, and third pipes 71, 72, and 73.

The refrigerant valve (not shown) is selectively opened or closed to prevent the refrigerant from flowing through the pipe 71, 72, or 73 connected to the indoor unit I1, I2, or I3 that is not driven among the plurality of indoor units I1, I2, and I3 while allowing the refrigerant to flow through the pipe 71, 72, or 73 connected to the indoor unit I1, I2, or I3 that is driven among the plurality of indoor units I1, I2, and I3.

The noise reduction device 100 according to one embodiment of the disclosure is disposed between the expansion device 30 and the outdoor heat exchanger 40, but the noise reduction device 900 according to another embodiment of the disclosure may be disposed between the outdoor heat exchanger 20 and the expansion device 30.

The refrigerant may be introduced into the noise reduction device 900 before flowing into the expansion device 30, so that the refrigerant with the flow thereof stabilized flows into the expansion device 30.

Accordingly, noise that may be generated when the refrigerant flows inside the indoor heat exchanger 40 as well as noise that may be generated when the refrigerant flows into the expansion device 30 may be reduced.

In a state in which the plurality of indoor units I1, I2, and I3 are connected to a single outdoor unit O, even when only some of the indoor units I1, I2, and I3 are driven, the compressor 10 may be driven in the same way as when all of the indoor units I1, I2, and I3 are driven.

When the refrigerant compressed by the compressor 10 flows into the plurality of indoor units I1, I2, and I3, some of the indoor units I1, I2, and I3 that are not driven may cause refrigerant cycle conditions to be formed differently and some refrigerant to have insufficient super-cooling degree, so that the refrigerant may flow into the indoor units I1, I2, and I3 in a two-phase state.

The noise reduction device 900 of the air conditioner 1 according to the present embodiment of the disclosure is disposed in each of the plurality of indoor units I1, I2, and I3 to prevent a two-phase refrigerant introduced into the indoor units I1, I2, and I3 from occurring noise while flowing through the expansion device 30 and the indoor heat exchanger 40.

That is, the noise reduction device 900 is provided to allow the refrigerant to pass therethrough before flowing into the expansion device 30 and the indoor heat exchanger 40 inside the indoor units I1, I2, and I3, so that noise is reduced.

Unlike the air conditioner 1 according to the above described embodiment of the disclosure, the expansion device 30 of the air conditioner 1 according to the embodiment of the disclosure is disposed inside each of the indoor units I1, I2, and I3. In addition, the noise reduction device 900 of the air conditioner 1 may be disposed inside each of the indoor units I1, I2, and I3.

Referring to FIGS. 24 and 25, the noise reduction device 900 includes a housing 910 including a refrigerant flow-in portion 911, a refrigerant flow-out portion 912, and a body 913 forming the external appearance thereof. The refrigerant flow-in portion 911 may be connected to a front part 71*a* of the first pipe 71, and the refrigerant flow-out portion 912 may be connected to a rear part 71*b* of the first pipe 71.

The body 913 may be provided in a cylindrical shape including a hollow. The body 913 may include an inner circumferential surface 914 forming the hollow and an internal space 915 formed as a hollow by the inner circumferential surface 914.

The noise reduction device 900 may include a structure body 920 including a plurality of baffles 921 and a frame 922 supporting the plurality of baffles 921. The structure body 920 may be provided to be inserted into the housing 110. The structure body 920 may be inserted into the internal space 915 formed on the inner circumferential surface 914 of the housing 910.

The structure body 920 may be formed in the same form as any one of the structure bodies 200, 300, 400, 500, 600, 700, and 800 disclosed in the above described embodiments of the disclosure.

The noise reduction device 900 may include a filter 930 provided to collect foreign substances in the refrigerant introduced into the refrigerant flow-in portion 911. The filter 930 may be disposed between the refrigerant flow-out portion 912 and the structure body 920. However, the disclosure is not limited thereto, and the filter 930 may be disposed between the refrigerant flow-in portion 911 and the structure body 920. The filter 930 may include a mesh member. As the refrigerant passes through the mesh member, foreign substances in the refrigerant may be collected by the filter 930.

The refrigerant introduced into the refrigerant flow-in portion 911 may have the flow thereof stabilized by passing through the structure body 920, and have foreign substances filtered out by passing through the filter 930. Thereafter, the refrigerant may flow out from the noise reduction device 900 through the refrigerant flow-out portion 912 and flow into the expansion device 30.

The structure body 920 and the filter 930 may be arranged in series in a direction in which the refrigerant flows in the internal space 915 of the noise reduction device 900.

The noise reduction device 900 may include a first fixing member 940 provided such that the structure body 920 is fixed to the internal space 915.

The noise reduction device 900 may include a second fixing member 950 provided such that the filter 930 is fixed to the internal space 915. The second fixing member 950 may fix the structure body 920 as well as the filter 930 to the internal space 915 at the same time. The first and second fixing members 940 and 950 may be disposed before and after the structure body 920 in the flow direction of the refrigerant. The first and second fixing members 940 and 950 may each be formed in a ring shape. The second fixing member 950 may be provided to maintain the shape of the mesh member by fixing the mesh member of the filter 930.

As described above, the filter configuration may be disposed between the expansion device 30 and the outdoor heat exchanger 20 to prevent foreign substances in the refrigerant flowing into the expansion device 30 from flowing into the expansion device 30.

In the case of the air conditioner 1 according to the embodiment of the disclosure, the indoor heat exchanger 40, the expansion device 30, and the noise reduction device 900 are all disposed inside the indoor units I1, I2, and I3. As a result, the internal spaces of the indoor units I1, I2, and I3 become narrower, so that the installation of the filter configuration in the indoor units I1, I2, I3 may be deteriorated.

That is, the filter configuration needs to be installed at an area before the expansion device 30 in the flow direction of the refrigerant, and to this end, the filter configuration needs to be disposed inside the indoor units I1, I2, and I3 because the expansion device 30 is disposed inside the indoor units I1, I2, and I3. However, since the indoor heat exchanger 40 and the noise reduction device 900 are disposed inside the indoor units I1, I2, and I3, it is not easy to install the filter configuration.

The noise reduction device 900 of the air conditioner 1 according to the of the disclosure includes the configuration of the filter 930 for collecting foreign substances of the refrigerant before the refrigerant is introduced into the expansion device 30, thereby obviating a need to additionally install a filter inside the indoor unit.

As is apparent from the above, the noise reduction device and the air conditioner having the same can reduce irregular refrigerant noise.

The noise reduction device and the air conditioner can stabilize the flow of an unstable refrigerant through a simple configuration.

Accordingly, the spatial efficiency of the interior of the indoor units I1, I2, and I3 may be increased, and due to omitting additional configuration, the number of parts of the indoor units I1, I2, and I3 is reduced, so that the material cost of the indoor units I1, I2, and I3 may be reduced.

Although a few embodiments of the disclosure have been shown and described, the above embodiments are for illustrative purposes only, and it would be appreciated by those skilled in the art that changes and modifications may be made in these embodiments without departing from the principles and scope of the disclosure, the scope of which is defined by the claims and their equivalents.

What is claimed is:

1. An air conditioner configured to be coupled to a refrigerant flow path, comprising:

a compressor configured to compress a refrigerant flowing in the refrigerant flow path;

an outdoor heat exchanger configured to exchange heat between the refrigerant and outdoor air;

an expansion device configured to expand the refrigerant;

an indoor heat exchanger configured to exchange heat between the refrigerant and indoor air; and a noise reduction device provided between the expansion device and the indoor heat exchanger, configured to be coupled to the refrigerant flow path and configured to reduce flow noise of the refrigerant which is moved as a two-phase refrigerant having a gas phase and a liquid phase, the noise reduction device including:

a housing including a refrigerant inlet and a refrigerant outlet; and a plurality of baffles disposed inside the housing and including a first baffle, a second baffle and a third baffle that partition an inside of the housing into a plurality of spaces in a flow direction of the refrigerant, each of the first baffle, the second baffle and the third baffle including a hole through which the refrigerant passes, the holes of the first, second and third baffles being disposed at centers of the first, second and third baffles.

2. The air conditioner of claim 1, wherein the holes of the first, second and third baffles are configured to be collinear with each other in the flow direction of the refrigerant.

3. The air conditioner of claim 1, wherein each of the first, and third baffles includes a first surface opposite to the flow direction, and each of the first surfaces includes a first inclined portion formed to be inclined from the hole in the corresponding one of the first and second baffles, toward a periphery of the corresponding one of first, second and third baffles in the flow direction of the refrigerant.

4. The air conditioner of claim 3, wherein each of the first, second and third baffles includes a second surface disposed on a side opposite to the first surface, and each of the second surfaces includes a second inclined portion symmetrical to the first inclined portion with respect to a direction perpendicular to the flow direction of the refrigerant.

5. The air conditioner of claim 1, further comprising an outdoor unit including the compressor and the outdoor heat exchanger, and an indoor unit including the expansion device and the indoor heat exchanger, wherein the noise reduction device is disposed in the indoor unit.

6. The air conditioner of claim 1, wherein:

the noise reduction device includes a frame coupled to the plurality of baffles, the frame includes a first frame and a second frame coupled to the plurality of baffles inside the housing, extending in the flow direction of the refrigerant, and individually separable in a direction perpendicular to the flow direction of the refrigerant, each of the plurality of baffles includes a first portion and a second portion separable in the direction perpendicular to the flow direction of the refrigerant, the first portions of the plurality of baffles are connected to the first frame, and the second portions of the plurality of baffles are connected to the second frame.

7. The air conditioner of claim 6, wherein the first portions of the plurality of baffles and the first frame form a first assembly of the noise reduction device, the second portions of the plurality of baffles and the second frame form a second assembly of the noise reduction device, and the plurality of baffles are formed when the first assembly and the second assembly are coupled to each other.

8. The air conditioner of claim 7, wherein each of the first assembly and the second assembly has a same shape and is provided as a unitary body.

9. The air conditioner of claim 7, wherein the first assembly has a first hook portion configured to be hooked with the second frame in the direction perpendicular to the flow direction of the refrigerant when the first assembly and the second assembly are coupled to each other in the direction perpendicular to the flow direction of the refrigerant, and the second assembly has a second hook portion configured to be hooked with the first frame in the direction perpendicular to the flow direction of the refrigerant when the first assembly and the second assembly are coupled to each other in the direction perpendicular to the flow direction of the refrigerant.

10. The air conditioner of claim 9, wherein the first frame is provided in a pair, and the first hook portion includes a plurality of hooks, and the plurality of hooks are alternately disposed on one of the pair of first frames and an other one of the pair of first frames in the flow direction of the refrigerant.

11. The air conditioner of claim 1, wherein each of the first baffle and the second baffle includes a plurality of ribs protruding from an outer circumferential surface thereof toward an inner circumferential surface of the housing while being spaced apart from each other in a circumferential direction of the outer circumferential surface thereof.

12. The air conditioner of claim 1, wherein the third baffle is disposed to be spaced apart from the first and second baffles in the flow direction of the refrigerant, each of the plurality of baffles further comprises a frame extending in the flow direction of the refrigerant so as to be coupled to one of the plurality of baffles adjacent thereto, the frame of the first baffle is coupled to the second baffle, and the frame of the second baffle is coupled to the third baffle, and the frame of the first baffle and the frame of the third baffle are disposed in-phase with each other in a circumferential direction of outer circumferential surfaces of the plurality of baffles, and the frame of the second baffle is disposed out of phase with the frame of the first baffle and the frame of the third baffle.

13. The air conditioner of claim 1, wherein the noise reduction device further comprises a filter configured to collect foreign substances in the refrigerant introduced through the refrigerant inlet.

14. The air conditioner of claim 1, wherein a filter is disposed in line with the plurality of baffles in the flow direction of the refrigerant inside the housing.

15. The air condition of claim 1, wherein the refrigerant flow path comprises a refrigerant pipe connected to the refrigerant inlet and the refrigerant outlet to connect the expansion device to the indoor heat exchanger, and the holes of the first and second baffles have a diameter which is less than 1.4 times a diameter of the refrigerant pipe and greater than one third times the diameter of the refrigerant pipe.

16. An air conditioner configured to be coupled to a refrigerant flow path, comprising:

a compressor configured to compress a refrigerant flowing in the refrigerant flow path;

an outdoor heat exchanger configured to exchange heat between the refrigerant and outdoor air;

an expansion device configured to expand the refrigerant;

an indoor heat exchanger configured to exchange heat between the refrigerant and indoor air; and a noise reduction device configured to be coupled to the refrigerant flow path and disposed between the expansion device and the indoor heat exchanger to reduce flow noise of the refrigerant which is moved as a two-phase refrigerant having a gas phase and a liquid phase and flows in the refrigerant flow path from the expansion device to the indoor heat exchanger, the noise reduction device including:

a plurality of baffles including at least three baffles having holes through which the refrigerant can flow, and the holes of the plurality of baffles being respectively disposed at centers of the plurality of baffles.

17. The air conditioner of claim 16, wherein the refrigerant flow path comprises a refrigerant pipe connecting the expansion device to the indoor heat exchanger, and the noise reduction device is inserted into the refrigerant pipe.

18. The air conditioner of claim 16, wherein the noise reduction device further comprises a housing including a refrigerant inlet and a refrigerant outlet, and the plurality of baffles are disposed inside the housing.

19. The air conditioner of claim 16, wherein the plurality of baffles have a same shape and are disposed at equal intervals in the flow direction of the refrigerant.

20. An air conditioner configured to be coupled to a refrigerant flow path, comprising:

a compressor configured to compress a refrigerant flowing in the refrigerant flow path;

an outdoor heat exchanger configured to exchange heat between the refrigerant and outdoor air;

an expansion device configured to expand the refrigerant;

an indoor heat exchanger configured to exchange heat between the refrigerant and indoor air; and a noise reduction device configured to be coupled to the refrigerant flow path disposed between the outdoor heat exchanger and the expansion device to reduce flow noise of the refrigerant which is moved as a two-phase refrigerant having a gas phase and a liquid phase and flows from the outdoor heat exchanger to the expansion device, the noise reduction device including:

a housing including a refrigerant inlet and a refrigerant outlet;

a plurality of baffles including at least three baffles having holes having centers aligned along an axis and through which the refrigerant flows; and a filter configured to collect foreign substances in the refrigerant introduced through the refrigerant inlet, the plurality of baffles being disposed in line with the filter in the flow direction of the refrigerant.

* * * * *